US011446549B2

(12) United States Patent
Maugeri et al.

(10) Patent No.: US 11,446,549 B2
(45) Date of Patent: Sep. 20, 2022

(54) DIGITALLY ENHANCED EXERCISE SYSTEM AND METHOD

(71) Applicant: Skop, Inc., Manhattan Beach, CA (US)

(72) Inventors: Kimberley Maugeri, Hermosa Beach, CA (US); Juha Nieminen, Altadena, CA (US); Egemen Alpay, Rancho Palos Verdes, CA (US); Genevieve Alpay, Rancho Palos Verdes, CA (US); Cody Clayton, Hermosa Beach, CA (US); Louis Amundson, Denver, CO (US)

(73) Assignee: Skop, Inc., Manhattan Beach, CA (US)

( * ) Notice: Subject to any disclaimer, the term of this patent is extended or adjusted under 35 U.S.C. 154(b) by 0 days.

(21) Appl. No.: 17/455,869

(22) Filed: Nov. 19, 2021

(65) Prior Publication Data

US 2022/0072378 A1 Mar. 10, 2022

Related U.S. Application Data

(63) Continuation of application No. 17/302,976, filed on May 17, 2021, now abandoned.
(Continued)

(51) Int. Cl.
*A63B 24/00* (2006.01)
*A63B 21/00* (2006.01)
*A63B 71/06* (2006.01)

(52) U.S. Cl.
CPC ..... *A63B 24/0062* (2013.01); *A63B 21/4045* (2015.10); *A63B 71/0622* (2013.01);
(Continued)

(58) Field of Classification Search
CPC ..... A63B 24/0062; A63B 21/4045; A63B 71/0622; A63B 2071/065; A63B 2220/833; A63B 2225/20; A63B 2230/015
See application file for complete search history.

(56) References Cited

U.S. PATENT DOCUMENTS 7,524,273 B1 * 4/2009 Martin ..... A63B 21/0552 482/121
8,131,498 B1 * 3/2012 McCauley ..... A61B 5/1036 177/144
(Continued)

FOREIGN PATENT DOCUMENTS

CN 109411052 A * 3/2019 ..... A61B 5/0075
WO 2006110412 A1 10/2006
(Continued)

OTHER PUBLICATIONS

International Search Report received for PCT International Application No. PCT/US2021/070569, dated Jan. 5, 2022, 2 pages.

*Primary Examiner* — Sundhara M Ganesan
(74) *Attorney, Agent, or Firm* — Kubota & Basol LLP

(57) ABSTRACT

A digitally enhanced exercise system includes a proximal section comprising a first structural member and a platform; a distal section comprising a second structural member and an interface, wherein the interface is attached to the second structural member by a mount; a spine that is spans between the first structural member and the second structural member; a carriage configured to move in a single axis along the spine; a tension system, wherein the tension system is capable of resisting the carriage from moving; a sensor array arranged so as to detect changes in weight on the carriage; and a processor. Other aspects are also described and claimed.

25 Claims, 19 Drawing Sheets

Related U.S. Application Data

(60) Provisional application No. 63/026,099, filed on May 17, 2020, provisional application No. 63/031,872, filed on May 29, 2020.

(52) U.S. Cl.
CPC ... *A63B 2071/065* (2013.01); *A63B 2220/833* (2013.01); *A63B 2225/20* (2013.01); *A63B 2230/015* (2013.01)

(56) References Cited

U.S. PATENT DOCUMENTS 8,152,705 B2 * 4/2012 Rooks ..... A63B 22/0087 482/142
8,192,338 B2 * 6/2012 Solow ..... A63B 22/0087 482/142
10,272,285 B2 * 4/2019 Lagree ..... A63B 22/0076
10,957,218 B1 * 3/2021 Lagree ..... G09B 5/06
10,996,119 B1 * 5/2021 Lin ..... A63B 21/4034
11,247,090 B1 * 2/2022 Lagree ..... A63B 21/045
2002/0151416 A1 * 10/2002 List ..... A63B 21/154 482/121
2004/0248713 A1 * 12/2004 Campanaro ..... A63B 21/068 482/123
2006/0183601 A1 * 8/2006 Couvillion, Jr. ..... A63B 22/025 482/8
2007/0027009 A1 2/2007 Arnold
2008/0200285 A1 * 8/2008 Haseth ..... A63B 63/00 473/422
2009/0124938 A1 * 5/2009 Brunner ..... A61B 5/1038 600/595
2010/0076347 A1 * 3/2010 McGrath ..... A63B 69/0053 600/595
2010/0246898 A1 * 9/2010 Izumi ..... A63B 6/00 382/106
2011/0269601 A1 * 11/2011 Nelson ..... A63B 71/0622 482/8
2012/0190503 A1 * 7/2012 Shavit ..... A63B 24/0062 482/5
2012/0190505 A1 * 7/2012 Shavit ..... A63B 24/0062 482/8
2014/0100089 A1 * 4/2014 Kermath ..... A63B 21/0428 482/133
2014/0330408 A1 * 11/2014 Rolley ..... G16H 10/60 700/91
2015/0065320 A1 * 3/2015 Anderson ..... A63B 21/156 482/142
2015/0190679 A1 * 7/2015 Carbone ..... A63B 21/0004 482/146
2015/0217164 A1 * 8/2015 Lagree ..... A63B 24/0087 434/247
2015/0290061 A1 * 10/2015 Stafford ..... A63B 21/4047 5/600
2015/0360083 A1 * 12/2015 Lagree ..... A63B 24/0087 482/130
2015/0364058 A1 12/2015 Lagree
2015/0364059 A1 * 12/2015 Marks ..... A61B 5/486 482/9
2016/0129293 A1 * 5/2016 Brown ..... A63B 23/03541 482/56
2016/0166870 A1 * 6/2016 Lagree ..... A63B 21/0552 482/142
2016/0271452 A1 * 9/2016 Lagree ..... A63B 22/0076
2017/0209742 A1 * 7/2017 Merkel ..... A63B 71/0622
2017/0225033 A1 * 8/2017 Czaja ..... A43B 5/0405
2017/0340947 A1 * 11/2017 Lagree ..... A63B 22/0089
2017/0368413 A1 * 12/2017 Shavit ..... A61B 5/1123
2018/0111033 A1 * 4/2018 Lagree ..... A63B 71/00
2018/0280782 A1 * 10/2018 Lagree ..... A63B 1/00
2018/0318646 A1 * 11/2018 Lagree ..... A61B 5/6895
2018/0353803 A1 * 12/2018 Lagree ..... G16H 40/63
2019/0247707 A1 * 8/2019 Lagree ..... G16H 20/30
2020/0188737 A1 * 6/2020 Villency ..... A63B 22/0002
2020/0254299 A1 * 8/2020 Kanuparthi ..... A61B 5/6892
2020/0353312 A1 * 11/2020 Smith ..... A63B 24/0075
2021/0016150 A1 * 1/2021 Jeong ..... G06V 40/10
2021/0101048 A1 * 4/2021 Lagree ..... A63B 22/0087
2021/0225196 A1 * 7/2021 Lagree ..... G09B 5/06
2022/0008788 A1 * 1/2022 Parsons ..... A63B 22/0087

FOREIGN PATENT DOCUMENTS

WO WO-2008007292 A1 * 1/2008 ..... A61B 5/1122
WO WO-2016149504 A1 * 9/2016 ..... A63B 21/023

* cited by examiner

DIGITALLY ENHANCED EXERCISE SYSTEM AND METHOD

CROSS-REFERENCE TO RELATED APPLICATIONS

The present application is a continuation of U.S. patent application Ser. No. 17/302,976, filed May 17, 2021, which claims the benefit of U.S. Provisional Application No. 63/026,099, filed May 17, 2020, and of U.S. Provisional Application No. 63/031,872, filed May 29, 2020, the disclosures of which are expressly incorporated by reference herein in their entireties.

FIELD

An aspect of the disclosure here relates to exercise equipment, specifically a system and method for digitally enhanced exercise. Other aspects are also described.

BACKGROUND

The importance of physical fitness is reflected in the diversity of exercise programs that have been developed over the centuries, each seeking to optimize the countless attributes that inform and direct the impact that any given exercise has on the human physique. The development of exercise equipment has in many ways mirrored the technological development of every aspect of human development; the rising efficiency of exercise tools has augmented conventional bodyweight exercise and continues to be a heavily investigated field.

Some exercise programs seek to use different combinations of balance, stretching, and machine-assisted tension to induce a well-rounded workout. One such example is Pilates, as implemented through reformer machines. As with many skills, practitioners of Pilates require high levels of instruction in order to safely and effectively engage in workouts.

SUMMARY

A digitally enhanced exercise system is a piece of workout equipment that may add functionality to conventional Pilates workouts and rehabilitation. The digitally enhanced exercise system may be light in weight. The digital aspects of the exercise system enable the system to provide instructions to a user. The instructions may be based on measured attributes of the user and the user's workout, allowing the system to provide feedback to the user in real-time.

The system may include a proximal section, a distal section, a carriage, a spine, and a tension system. The proximal section may include a platform and a first structural member. The distal section may include a second structural member and an interface. The distal section and the proximal section may be connected by a spine. The carriage may also be connected to the spine and may be able to move slidably along one axis via the spine.

The carriage may connect to a tension system that may be attached to the distal section and/or the proximal section. The tension system may include springs with varying tensions that may be adjusted in order to change the resistance that the tension system is able to produce. The tension system may be engaged by the user by moving the carriage toward the platform, when tension members are connected between the carriage and the distal section, increasing the amount of tension. Likewise, when tension members are connected between the carriage and the platform, tension may increase when the carriage is moved toward the distal section.

The platform and carriage may include sensors that are able to measure various attributes of the user, the system, and the user's workout. One set of sensors may be for measuring weight distribution across the system. For instance, if a user is standing with a left foot on the platform and a right foot on the carriage, the system may determine the weight distribution of the user. This information may be used to help a user achieve proper weight balance across the system while engaged in a workout using the system. This information may be pertinent for optimized exercise, injury prevention, rehab, etc. The tension system may also contain sensors that determine the amount of tension that is on the system. Other sensors may be used to determine, but are not limited to, the position of the carriage, the rate of change of the carriage position, the rate of change of tension within the tension system, and user attributes such as heart rate.

The exercise system may have an interface that allows the user to interact with the system and view relevant information. For example, a user may elect to join a live or archived workout which may then be displayed on the interface, along with data relating to the current and/or past workouts of the user. This will allow a user to self-adjust while using the system without necessitating an in-person instructor. The data also allows for accurate workout feedback that may not be otherwise available. The system may interact with remote systems, allowing the exchange of relevant workout information and enabling the user to tap into a global network of users and instructors.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Figure 1:
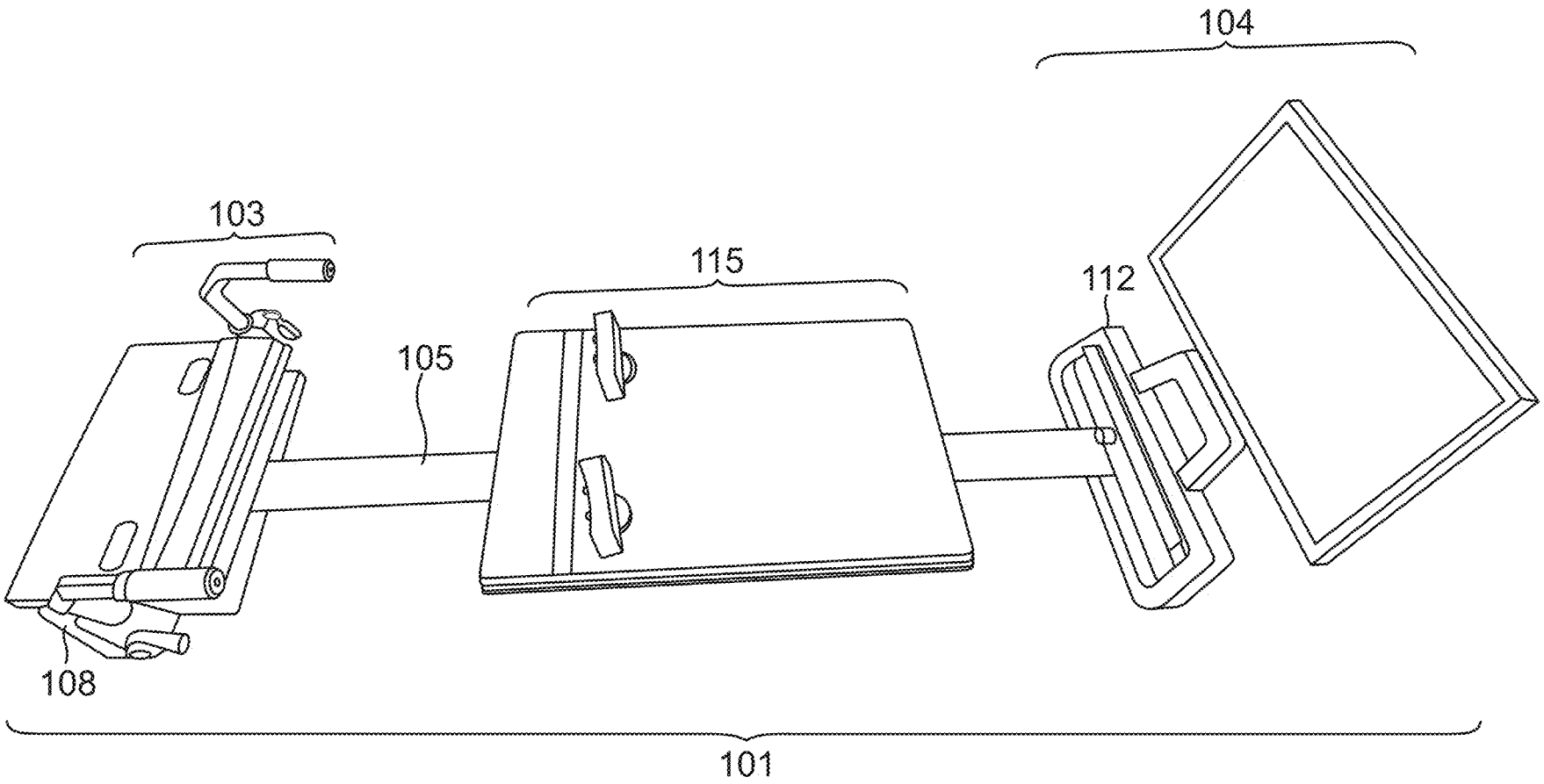
FIG. 1 illustrates an exemplary digitally enhanced exercise system.

Several aspects of the disclosure with reference to the appended drawings are now explained to enable any person skilled in the art to make and use the invention. For purposes of explanation, specific nomenclature is set forth to provide a thorough understanding of the present invention. Descriptions of specific embodiments or applications are provided only as examples. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Unless otherwise indicated, all numbers and expressions, such as those expressing dimensions, physical characteristics, etc., used in the specification (other than the claims) are understood as modified in all instances by the term "approximately" or "about". At the very least, and not as an attempt to limit the application of the doctrine of equivalents to the claims, each numerical parameter recited in the specification or claims which is modified by the term "approximately" or "about" should at least be construed in light of the number of recited significant digits and by applying rounding techniques. Moreover, all ranges disclosed herein are to be understood to encompass and provide support for claims that recite any and all sub-ranges or any and all individual values subsumed therein. For example, a stated range of 1 to 10 should be considered to include and provide support for claims that recite any and all subranges or individual values that are between and/or inclusive of the minimum value of 1 or more and ending with a maximum value of 10 or less (e.g., 5.5 to 10, 2.34 to 3.56, and so forth) or any value from 1 to 10 (e.g., 3, 5.8, 9.9994, and so forth).

An aspect of the present disclosure is directed toward a digitally enhanced exercise system, herein referred to as "the exercise system" or "the system." The exercise system may include elements that are characteristic of a Pilates reformer machine, such as, for instance, a moveable carriage and a tension system. In various embodiments, the exercise system may include aspects that measure attributes of the performance of a user. This allows the system to provide instruction and give feedback to the user.

Turning to FIG. 1, various aspects of the exercise system 101 are shown. The system 101 may include a proximal section 103 and a distal section 104 that are connected by a spine 105, and a carriage 115 that is disposed between the proximal section 103 and the distal section 104 and slidably connected to the spine 105, with these elements forming the core of the structure of the system 101.

The spine 105 may attach to the proximal section 103 on a first structural member 108 and may attach to the distal section 104 on a second structural member 112, such that the spine 105 may span between the first structural member 108 and the second structural member 112. In the illustration, the spine 105 is connected to the first structural member 108 on a top side of the first structural member 108, and the spine 105 is connected to the second structural member 112 on a top side of the second structural member 112. The spine 105 may be connected to the structural members 108, 112 in a manner that elevates the spine 105 from the ground. The spine 105 may be formed from wood, plastic, metal, or any sufficiently sturdy material. In an aspect of the disclosure, it may be desirable for the spine 105 to be strong while also balancing for the weight of the member in order to allow the system 101 to be portable. In this case, a material or alloy may be selected with a sufficient strength-to-weight ratio, such as, but not limited to, titanium, steel, and aluminum. It may be desirable for the spine 105 to be hollow, which would allow the spine 105 to contain power cables, wires, and other elements of the system 101. Thus, the spine 105 may be formed from tubing or piping. Other shapes and configurations for the spine 105 are contemplated. For instance, the spine 105 may be formed from sheets that create a rectangular, hollow member. The spine 105 may be formed from one continuous tube member such as through extrusion, or from several tube members that may connect or be fastened together to form the spine 105. It may be desirable for the spine 105 to retract or telescope, such as for storage or assembly. Similar, the spine 105 may include a hinge or other means of allowing the spine 105 to reduce in size or footprint.

The structural members 108, 112 may be similar in design and configuration to each other. The structural members 108, 112 may be frames that consist of a rectangular structure made from wood, plastic, metal, or any material capable of maintaining the shape of the structure while the structure is under load or tension. The structural members 108, 112 may be hollow to decrease weight. In the illustration shown, the structural member 108, 112 may take the form of a substantially rectangular member with a bottom wall that rests on the ground, a top wall that is connected to another element of the system 101, and side walls that connect the top wall and the bottom wall. In another embodiment, the bottom wall may be absent, such that the side walls act as feet that rest on the ground and elevate the top wall. In yet another embodiment, the top wall and bottom wall may be absent, and the side walls may form an "A" type structure, wherein the side walls may connect to another element of the machine, elevating said element, and act as feet that rest on the ground. Other designs for the structural members 108, 112 may be considered without straying from the inventive concept. The structural members 108, 112 may have attachment points for various aspects of the system 101, such as for the spine 105. It is contemplated that the first structural member 108 and the second structural member 112 may be located within the system 101 other than that shown, such as at intermediary points, or that a greater or fewer number of structural members 108, 112 may be included. For instance, a structural member 108, 112 may be included at a midpoint between the first structural member 108 and the second structural member 112. The structural members 108, 112 may include elements that ease movement and transportation of the system 101, such as wheels, handles, and joints that enable the system 101 to fold and be moved to a different location when the exercise system 101 is not in use.

In an aspect of the present disclosure, the spine 105 may be replaced by several poles, such that the exercise system 101 may instead have multiple rails. The rails may span between the first structural member 108 and the second structural member 112, such that the multiple rails may be substantially parallel to each other and offset from a central axis of the exercise system 101. It is further considered that the rails may be included within the exercise system in addition to the spine 105.

Figure 2:
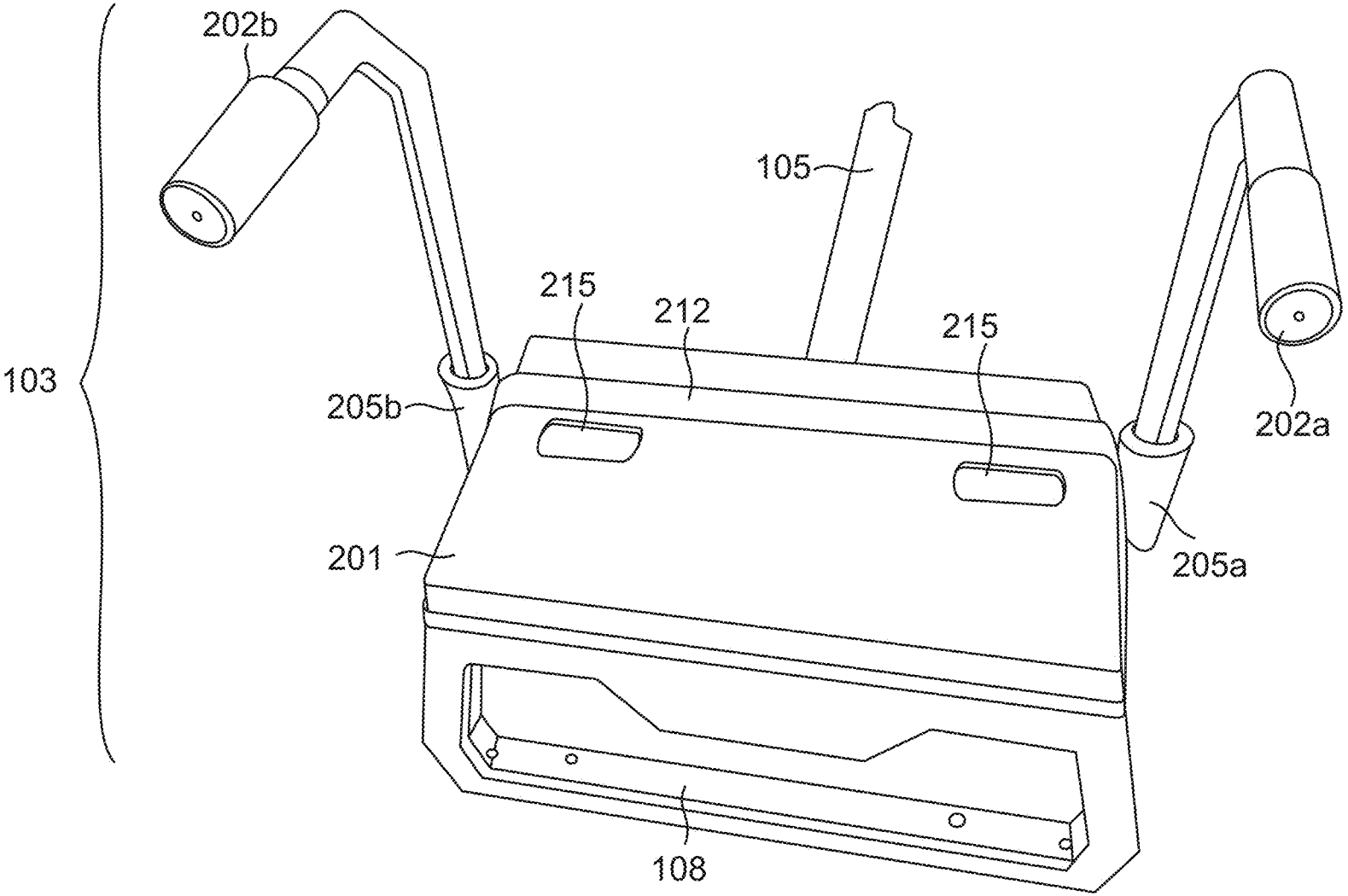
FIG. 2 illustrates an exemplary proximal section for a digitally enhanced exercise system.

Aspects of the proximal section 103 are shown in FIG. 2. The first structural member 108 of the proximal section 103 may be connected to a platform 201. The platform 201 may be a member with a flat face connected to the first structural member 108 in order to allow the platform 201 to accommodate the weight of a user, such as when the user has a foot or hand positioned on the platform 201. Thus, the platform 201 may have the flat face positioned parallel to the ground and elevated from the ground. The platform 201 may include a substantially rectangular frame or a board formed from a sturdy material, such as metal, plastic and wood. The platform 201 may be padded or cushioned, although it is considered that the platform 201 may be left as a hard surface. The platform 201 may be upholstered with a material such as cotton, linen, wool, leather, acetate, hemp, silk, polyester, polypropylene, acrylic, rayon, nylon, or any of known organic and synthetic materials. The platform 201 may be fastened to the first structural member 108 on one end of the platform 201. The platform 201 may also be supported by or attached to the spine 105, such that the first structural member 108 and the spine 105 brace the platform 201 in a "T" shape, forming a stable base for the platform 201.

The platform 201 may have an insertion point 205*a*, 205*b* where a handle bar 202*a*, 202*b* may be removably fastened to the platform 201. The insertion point 205*a*, 205*b* may include a tightener for locking the handle bar 202*a*, 202*b* in place when the handle bar 202*a*, 202*b* is inserted into or connected to the insertion point 205*a*, 205*b*. The handle bar 202*a*, 202*b* may be an upright member that can support some or all of the weight of the user. The handle bar 202*a*, 202*b* may be formed from a sufficiently sturdy material to maintain rigidity under load, such as metal, plastic, and wood. In the illustration, the handle bar 202*a*, 202*b* is tubular in shape, and is substantially perpendicular to the spine where the handle bar 202*a*, 202*b* meets the insertion point. The handle bar 202*a*, 202*b* has a bended segment, such that the portion of the handle bar 202*a*, 202*b* that is furthest from the insertion point 205*a*, 205*b* is substantially parallel to the spine 105. It may be possible to lock the handle bar 202*a*, 202*b* in place with variable orientations, such that, for instance, the handle bar 202*a*, 202*b* may be oriented with the extended portion of the handle bar 202*a*, 202*b* pointing toward the carriage 115, the handle bar 202*a*, 202*b* may be oriented with the extended portion of the handle bar 202*a*, 202*b* pointing away from the carriage 115, or any orientation in between. There may be a first handle bar 202*a* and a second handle bar 202*b*, wherein the first handle bar 202*a* corresponds with a first insertion point 205*a* located on a left side of the system 101 and the second handle bar 202*b* corresponds with a second insertion point 202*b* located on a right side of the system 101.

Different types of handlebars are contemplated. In an embodiment, the handle bar may a single member that is U-shaped and inserts into both insertion points 205*a*, 205*b*, such that a left side may go into the first insertion point 205*a* and right side may go into the second insertion point 205*b*, although the handle bar may be flipped such that the inverse insertion points 205*a*, 205*b* may be used.

The handle bars 202*a*, 202*b* may have attributes that make switching the orientation of the handle bars 202*a*, 202*b* desirable, such as a bend that allows the handle bars 202*a*, 202*b* to tilt in a specified direction. The handle bars 202*a*, 202*b* may be telescopic and/or swiveling in order to allow the height and/or orientation of the handle bars 202*a*, 202*b* to be changed by a user in accordance with the user's preference. The handle bars 202*a*, 202*b* may have a sliding mechanism, such that a first segment may be nested inside of a second segment and locked in place with a pin that extends out from the first segment through a series of holes in the second segment. Pressing the pin back into the hole that the pin extends out from may allow the first segment to slide within the second segment, having the effect of allowing a user to adjust the height of the handle bars 202*a*, 202*b* in a similar fashion to the height adjustment mechanism for crutches. The handle bars 202*a*, 202*b* may include other accessories that contribute to user comfort and proper usage, such as padding and instructional indicators, including various labels or coloring that corresponds with usage information.

A band 212 may be attached on a left side and a right side of the platform 201 so as to span across the platform 201. The band 212 may be made from a rigid material, such as metal and plastic. It may be desirable for the band 212 to be flexible or have "give," and so a less rigid material may be used, including cloth, fabric, leather, and elastic. The band 212 may be used as a hand- or foothold by a user during a workout, and so the band 212 may be loose enough to be pulled away from the platform 201.

The platform may include cutouts 215 that pass through the platform 201. The cutouts 215 may be sized and positioned so as to serve as hand holds for a user during a workout. In the illustration, two cutouts 215 are located on the platform, although fewer or more cutouts 215 may be considered. The cutouts 215 may also be used by components as a mated insert. For instance, a jump board may have two inserts that mate with the cutouts 215, allowing the jump board to stay in place on the platform.

Figure 3:
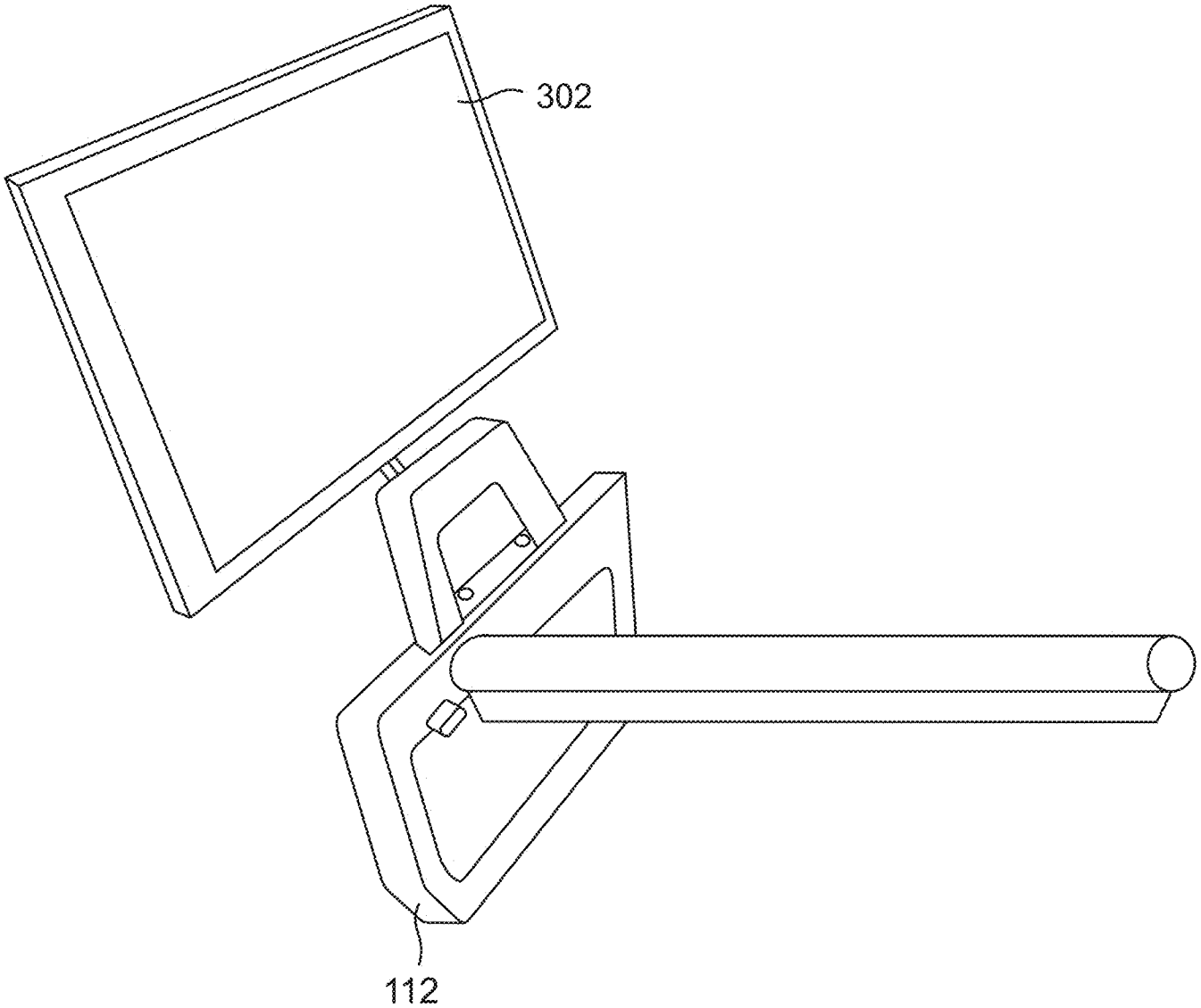
FIG. 3 illustrates an exemplary distal section for a digitally enhanced exercise system.
Figure 4:
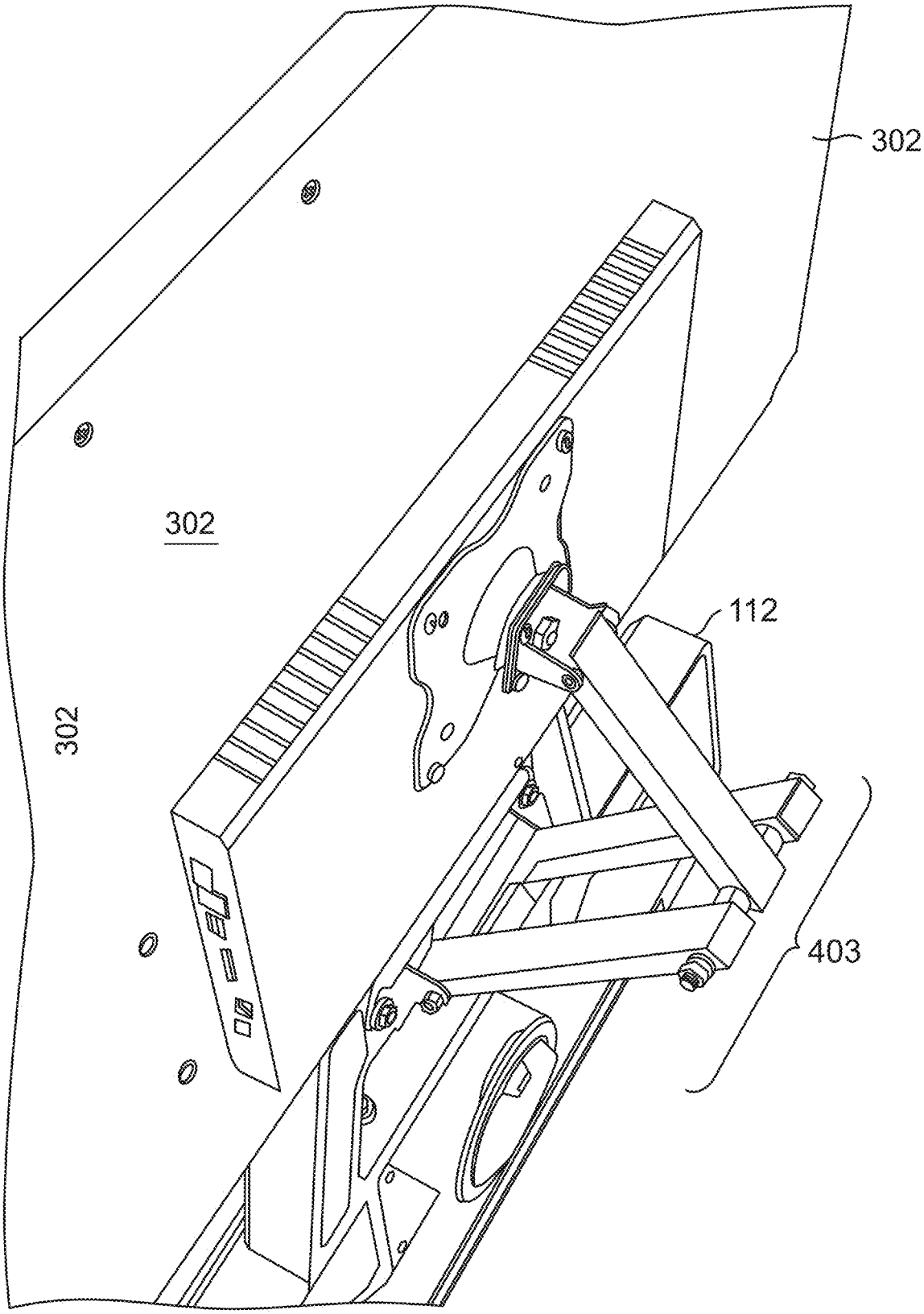
FIG. 4 illustrates an exemplary interface mount for a digitally enhanced exercise system.

FIG. 3 demonstrates the distal section 104. The second structural member 112 may include a mount for an interface 302. The interface 302 may include a screen with input and output capabilities, such that a user is able to interact with the interface 302, such as by viewing information displayed on the interface 302 and selecting options that are presented on the interface 302. The screen of the interface 302 may be a touch screen, have buttons, a microphone for receiving voice commands, or be responsive to instructions received from an outside device that is remotely connected to the system 101. The interface 302 may be oriented so that it is viewable by a user who may be located on or near the carriage 105 or the platform 201. The interface 121 may be attached to second structural member 112 by a mount 403, such as that shown in FIG. 4. The mount 403 may include a hinge or other mechanism to allow for adjustment of the position or orientation of the interface 302, such as by pivoting, rotating, and extending. In another embodiment, the display screen may be attached elsewhere to the system 101, such as to the spine 105 or to the first structural member 108, or the interface 302 may be mounted separately. In an aspect, the interface 302 may be a separate device, such as a smart phone, tablet, laptop, smart television, or similar electronics device that has a screen.

Figure 5:
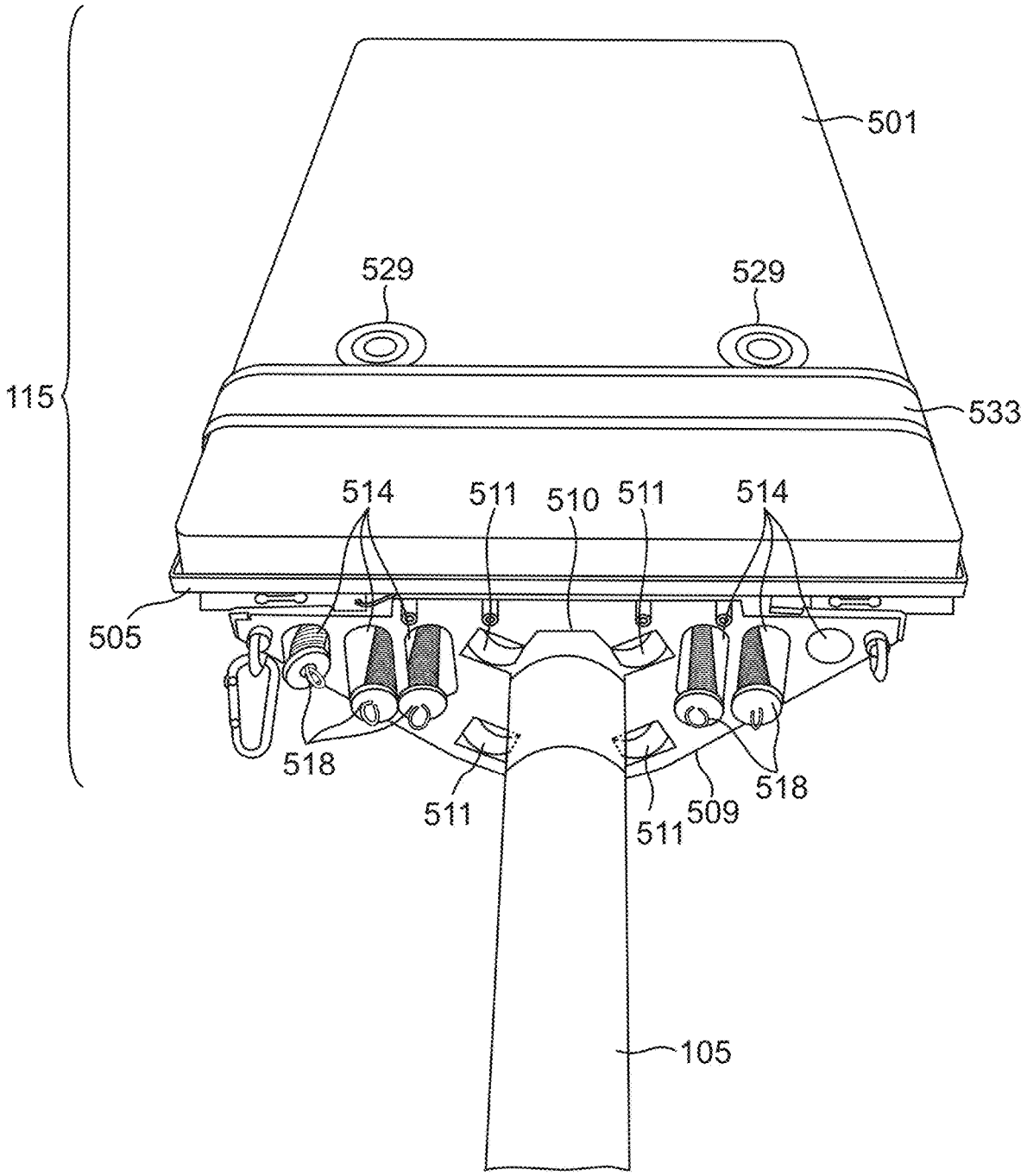
FIG. 5 illustrates an exemplary carriage for a digitally enhanced exercise system.

Referring to FIG. 5, the carriage 115 may include a top portion 501 that is attached to a carriage frame 505. The top portion 501 may be substantially rectangular in shape, although it is conceived that that top portion 501 may be square, circular, or other designs. The top portion 501 may have a flat top that is substantially parallel to the ground and faces upward. The top portion 501 may be a frame or board formed from a sturdy material, such as metal, plastic and wood. The top portion 501 may be padded or cushioned, although it is considered that the top portion 501 may be left as a hard surface. The top portion 501 may be upholstered with a material such as cotton, linen, wool, leather, acetate, hemp, silk, polyester, polypropylene, acrylic, rayon, nylon, or any of known organic and synthetic materials.

The carriage frame 505 may include a frame plate 509 that is disposed on an end of the carriage frame 505, such as an end of the carriage frame 505 that is perpendicular to the spine 105. The frame plate 505 may include an element that allows the carriage 115 to move in a single axis along the spine 105, such that the carriage 115 may slidably move. For instance, the frame plate 509 may include a hole 510 that the spine 105 may pass through. The frame plate 509 may include a means for allowing the carriage to slide smoothly along the spine 105 while restricting motion in other directions, such as lateral or yaw motion. In this way, the spine 105 serves as a rail for the carriage 115 to slide upon. For instance, in the example shown, the frame plate 509 may include a set of bearings 511 that are attached to the frame plate 509 and interface with the spine 105. The bearings 511 may be shafts, axles or wheels. In the illustration, the bearings 511 are shown to be a pair of wheels, with each wheel having an axle that is fixed on opposing sides of the spine 105, although other arrangements may be contemplated. The bearings 511 may rotate when the carriage 115 slides along the spine 105, allowing for smooth motion and restricting unwanted degrees of freedom. Further, the spine 105 may include a wing that assists in stabilizing the carriage 115 against unwanted degrees of freedom. For instance, the wing may extend substantially vertically below or above the spine 105. The frame plate 509 may include additional bearings 511 that interface with the wing, such that the bearings 511 are oriented approximately perpendicularly to the wing and adjacent to the wing. The additional bearings 511 may resist lateral motion while ensuring that the carriage 115 is able to slide smoothly. The wing may be fastened to the spine 105, formed as part of the spine 105, such as by extrusion, be separate from the spine 105 so as to connect between the first structural member 108 and the second structural member 112, or otherwise be located adjacent to the spine 105. Other means of allowing the carriage 115 to slide within the system 101 while remaining stable against unwanted degrees of freedom may be considered. For instance, the spine 105 may contain a groove, and the frame plate 509 may include a tongue portion that engages with the groove in a slidable fashion, such as with bearings 511. Further, where the system 101 includes rails rather than, or in addition to, the spine 105, the rails may interface with the frame plate 509 so as to allow the carriage 115 to slide on the rails.

The carriage 115 may include two frame plates 509 that bookend the carriage frame 505 such that the frame plates 509 are parallel to each other and perpendicular to the spine 105. The frame plates 509 may be connected by metal sheets that wrap around the flat top portion 503 such that the carriage frame may be substantially enclosed.

The carriage 115 may also include shoulder block holes 529. The shoulder block holes 529 may be mated insertion points for a shoulder block or another accessory that may attach to the carriage. The shoulder block holes 529 may be threaded and interlock with a matching element with screw-like rod, although other means of interlocking are considered. Shoulder blocks may be elements that extend perpendicularly from the top portion 501 of the carriage 115 in order to provide a surface for a user to use as leverage during workouts. In the illustration, two shoulder block holes 529 are shown to be on a left and a right side of the top portion 501 of the carriage 115 and disposed on an end of the carriage 115 that is closer to the proximal section 103. It is considered that more or fewer shoulder block holes 529 are conceivable; for instance, an additional set of shoulder block holes 529 may be disposed on an end of the carriage 115 that is closer to the distal section 104, bringing the total number of shoulder block holes 529 to four.

A band 533 may be attached on a left side and a right side of the carriage 115 and span across the top portion 501 of the carriage 115. The band 533 may be made from a rigid material, such as metal and plastic. It may be desirable for the band 533 to be flexible or have "give," and so a less rigid material may be used, including cloth, fabric, leather, and elastic. The band 533 may be used as a hand- or foothold by a user during a workout, and so the band 533 may be loose enough to be pulled away from the top portion 501 of the carriage 115. Although the illustration shows one band 533 located on an end of the carriage 115 closer to the proximal section 103, the carriage 115 may include several bands 533, such as an additional band 533 located on an end of the carriage 115 closer to the distal section 104.

FIGS. 5-8 show aspects of a tension system that introduces resistance to the system 101 upon sliding the carriage 115. When the tension system is activated, tension increases when a user pushes the carriage 115 further away from a stationary position, and when the force is removed the carriage 115 is pulled back toward the stationary position. Returning to FIG. 5, the tension system may include a spring attachment hook (not shown). The spring attachment hook may be a ring, peg, loop, hook, clasp, or other mechanical device capable of attaching to or interconnecting with a mated element. The spring attachment hook may be located on or within the carriage 115, such as on or inside the frame plate 509. For instance, the illustration shows six vents 514 that contains the spring attachment hook. Alternatively, the spring attachment hook may be fastened to the frame plate 509, and may be substantially parallel to the spine 105, such that the spring attachment hook may be facing outward from the carriage 115.

In the example shown, the frame plate 509 includes six spring attachment hooks, with three spring attachment hooks on the left of the spine 105 and three spring attachment hooks on the right of the spine 105. It is conceivable that there may be more or fewer spring attachment hooks associated with each frame plate 509. For instance, there may be eight spring attachment hooks or four spring attachment hooks. Generally, there may be an even number of spring attachment hooks so that the "total tension", which may include a summation of the number of tension members used and the strength of each tension member, may be substantially similar on the left side and the right side of the spine 105. The frame plates 509 on both ends of the carriage 115 may have a similar or substantially identical configuration of spring attachment hooks.

The spring attachment hook may serve as the anchor for a tension member 518. The tension member 518 may be an elastic object that stores mechanical energy and is resistant to tension, such as a spring or band. For instance, the illustration shows the tension member 518 as a coil spring. The tension member 518 may be selected from a set of tensions members 518, wherein each of the set of tension members 518 have a different force profile. For instance, the set of tension members 518 may include a ten-newton tension member, a twenty-newton tension member, and a thirty-newton tension member from which a user may select. It is contemplated that the set of tension members 518 may include a tension member that produces between zero- and ten-newtons of force. It is further contemplated that the set of tension members 518 may include a tension member 518 that produces greater than thirty newtons of force. Generally, the set of tension members 518 may include tension members 518 that are scaled from relatively stronger and relatively weak. In general, it is common for tension members 518 used in reformer machines to be grouped by color, such that tension members 518 that are yellow are of similar strength, tensions members 518 that are green are of similar strength, etc. In FIG. 5, there are five tension members 518 that are connected to the carriage 115.

Figure 6:
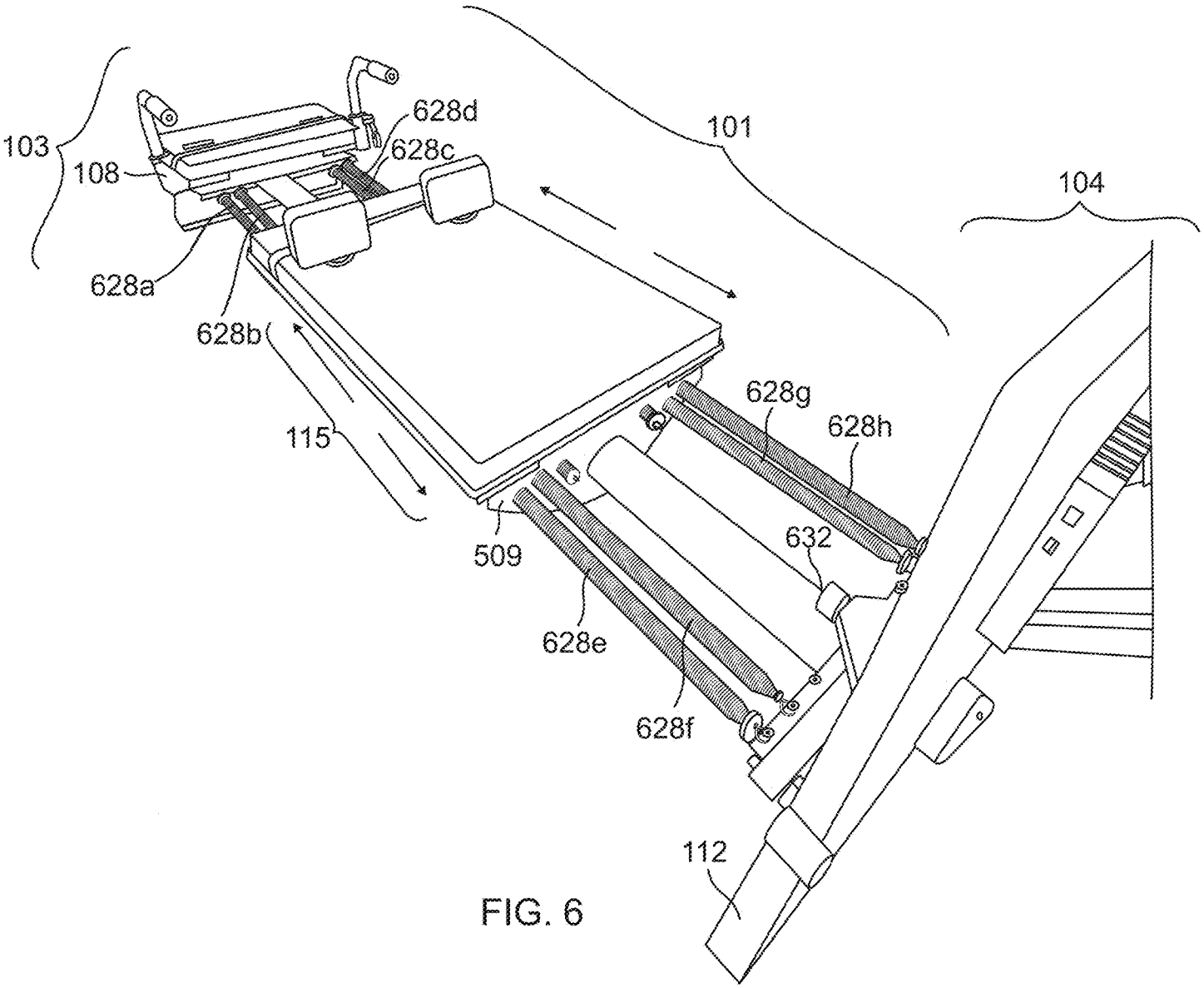
FIG. 6 illustrates an exemplary tension system for a digitally enhanced exercise system.

FIG. 6 demonstrates tension members 628*a-h* fully attached and in tension, such that the carriage 115 is balanced between the proximal section 103 and the distal section 104. The tension members 628*a-h* may connect to a spring attachment hook on the carriage 115 on a first end of the tension members 628*a-h* and to a corresponding attachment point, such as on the first structural member 108 or on the second structural member 112, and on a second end of the tension members 628*a-h*, such that the tension members 628*a-h* may span between either the carriage 115 and the proximal section 103 or the carriage 115 and the distal section 104. When fully connected, the tension members 628*a-h* are substantially parallel to the spine 105. Likewise, there may be a tension member 628*a-h* that connects between each spring attachment hook and corresponding attachment point. In the illustration, eight tensions members 628*a-h* are connected within the system 101, such that there are four tension members 628*a-d* connected between the carriage 115 and the proximal section 103, and four tension members 628*e-h* connected between the carriage 115 and the distal section 104. The tension members 628*a-h* shown are equal, such that the carriage is held in place between the proximal section 103 and the distal section 104. Thus, when the carriage 115 is pushed or pulled toward the proximal section 103, tension members 628*e-h* may increase resistance exponentially in relation to the distance from the distal end 104. Similarly, when the carriage 115 is pushed or pulled toward the distal section 104, tension members 628*a-d* may increase resistance exponentially in relation to the distance from the proximal section 103.

Not all tension members 628*a-h* need be attached; it is possible, for instance, to attach to the system 101 any combination of the tension members 628*a-h*. For example, the carriage 115 may only be connected on one side, such as only to tension members 628*a-d*, and tension members 628*e-h* may be removed. This configuration will have the effect of pulling the carriage 115 toward the proximal section 103, so that the carriage 115 may be resting against the proximal section 103 when stationary. Similarly, only tension members 628*e-h* may be connected and tension members 628*a-d* may be removed from the system 101, which will have the effect of bringing the carriage to rest against the distal section 104 when stationary. Further, each of the tension members 628*a-h* may be of the same force profile or have differing force profiles. The tension members 628*a-h* may be easily removed or added to the system 101. In this way, varying numbers of tension members 628*a-h* may be engaged within the system 101 any given time, up to the number of spring attachment hooks and corresponding attachment points that are available. Further, the tension members 628*a-h* may be added or subtracted from one or both sides of the system 101, such that there may be a mirrored setup on both sides of the system 101 or there may be different setups on both sides of the system 101, in both number of tension members 628*a-h* utilized and the force profile of the tension members 628*a-h* utilized. The placement and selection of the tension members 628*a-h* within the system 101 is customizable to a user's preference or as part of an instructed workout.

When attached, tension members 628*a-h* may have the impact of creating resistance when attempting to slide the carriage 115 away from the structural member 108, 112 that the tension members 628*a-h* are connected to. The number of tension members 628*a-h* that are connected between the carriage 115 and structural member 108, 112 may correspond with resistance when moving the carriage 115 in a direction opposed by the tension member 628*a-h*, such that when fewer tension members 628*a-h* are connected less force is required to move the carriage 115, and when more tension members 628*a-h* are connected, greater force is required to move the carriage 115, when comparing tensions members 628*a-h* with equivalent force profiles. When only tension members 628*a-d* are connected, resistance may increase when attempting to slide the carriage 115 toward the distal section 104, and when only tension members 628*e-h* are connected, resistance may increase when attempting to slide the carriage 115 toward the proximal section 103.

Other mechanisms that provide varied tension when moving the carriage 115 are considered. For example, resistance bands with varying degrees of resistance may be utilized. In another example, an electromagnetic engine may be utilized, wherein pulleys may wrap around the engine and are attached between the proximal section 103, distal section 104, and the carriage 115. The resistance the engine produces may be adjusted mechanically, such as with a resistance knob, or digitally.

The system 101 may include stoppers 632 located on the structural members 108, 112 that are intended to prevent damage to the system 101 when the carriage 115 hits into the proximal section 103 and distal section 104. The stoppers 632 may be made from a material capable of absorbing the force of the carriage, such as rubber and plastic. The stoppers 632 may extend out from the structural members 108, 112 so as to provide a gap between the carriage 115 and the structural members 108, 112. Other means of shock absorption are considered.

Figure 7:
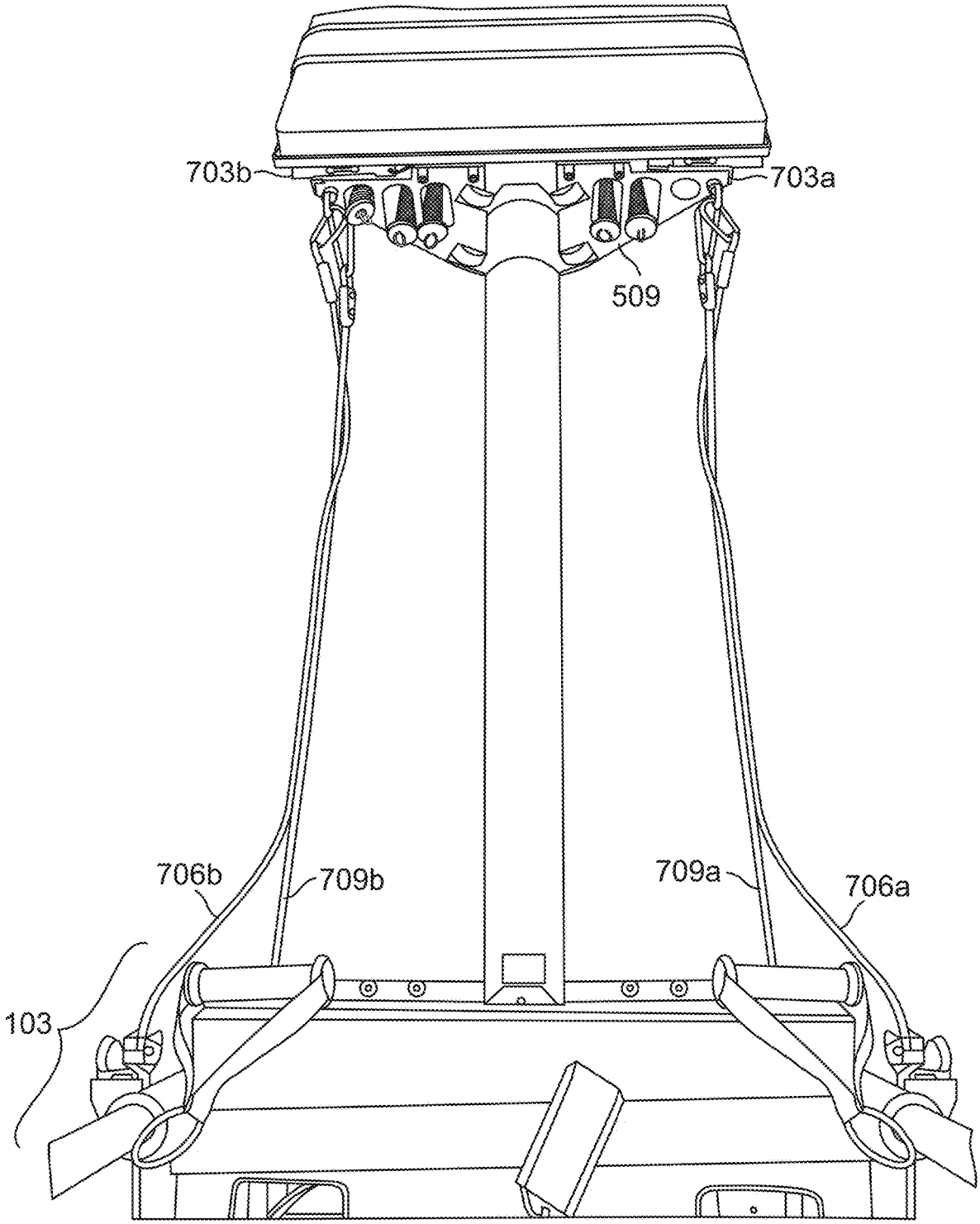
FIG. 7 further illustrates aspects of a tension system for a digitally enhanced exercise system.
Figure 8:
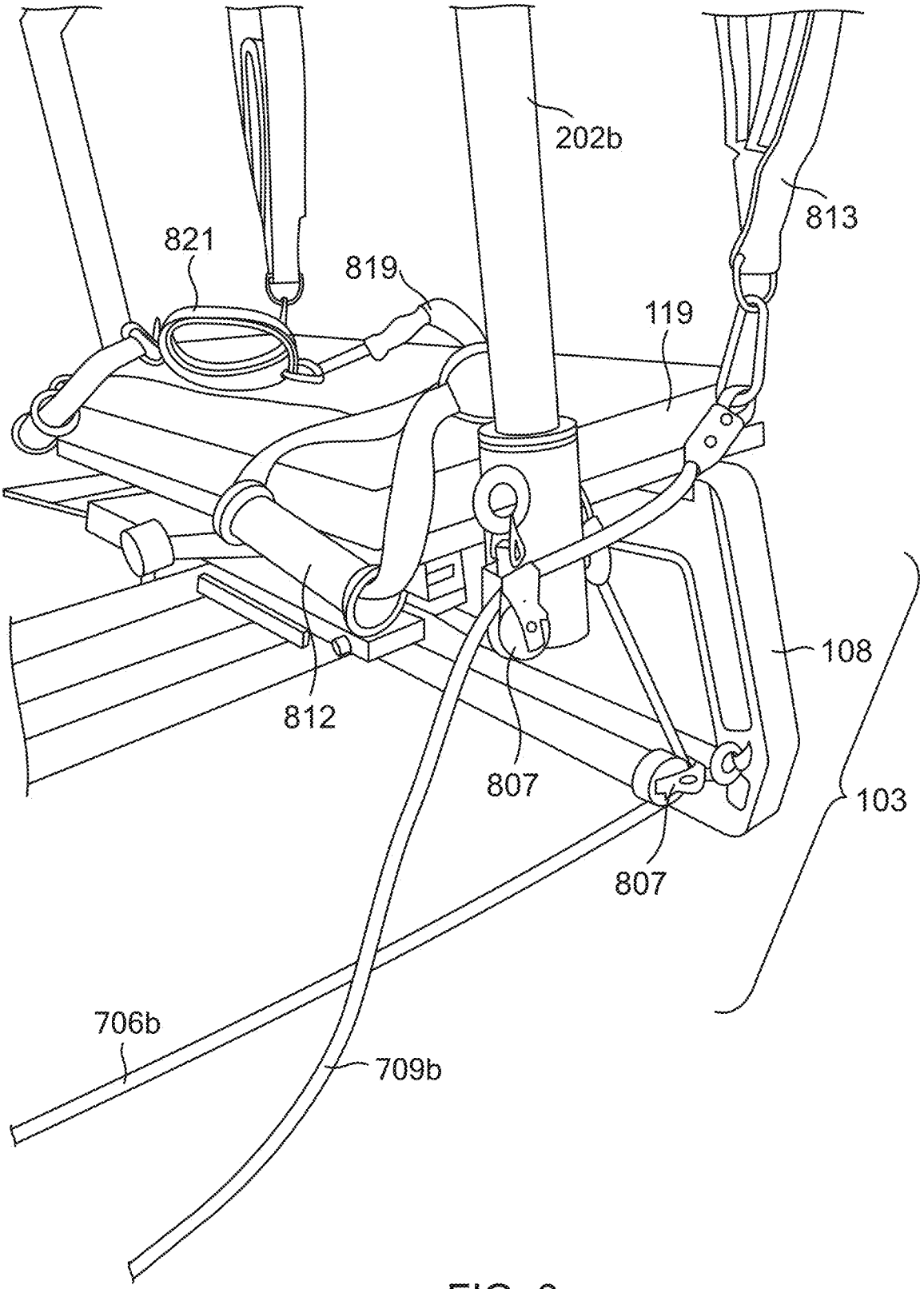
FIG. 8 illustrates additional aspects of a tension system for a digitally enhanced exercise system.

FIGS. 7-8 demonstrate aspects of a pulley system that is incorporated within the exercise system 101. The pulley system may include a pulley attachment clip 703*a*, 703*b* that is fastened to the frame plate 509 and facing outward, such that the pulley attachment clip 703*a*, 703*b* is on the face of the frame plate 509 that is facing the proximal section 103. There may be more than one pulley attachment clip 703*a*, 703*b*, such that there may be a first pulley attachment clip 703*a* disposed on a first end of the frame plate 509 and a second pulley attachment clip 703*b* that is disposed on a second end of the frame plate 509. The first pulley attachment clip 703*a* and the second attachment clip 703*b* may have the effect of "bookending" the spring attachment hooks, such that the pulley attachment clips 703*a*, 703*b* may occur or be positioned at the end or on either side of the spring attachment hooks. A first strap 706*a* may connect on a first end of the first strap 706*a* to the first pulley attachment clip 703*a*, and a second strap 706*b* may connect on a first end of the second strap 703*b* to the second pulley attachment clip 703*a*. It is considered that multiple straps 706*a*, 706*b* may be attached to a single pulley attachment clip 703*a*, 703*b*. For instance, a third strap 709*a* is shown to be connected to the first pulley attachment clip 703*a*, and a fourth strap 709*b* is shown to be connected to the second pulley attachment clip 709*b*. The straps 706*a*, 706*b*, 709*a*, 709*b* may be made from a strong and flexible material, such as rope, wire, and rubber, and may include a clip at first end that mates with the pulley attachment clip 703*a*, 703*b* and that allows easy attachment and removal.

FIG. 8 shows aspects of the pulley system that are on the proximal section 103 of the system 101. There may be a pulley 807 that is located on the first structural member 108, such that the pulley 807 may correspond with a pulley attachment clip 703*a*, 703*b*. For instance, the pulley 807 may be disposed on the same side of the machine as the first pulley attachment clip 703*a*, and thus correspond with said first pulley attachment clip 703*a*, and similarly another pulley 807 may be disposed on the opposite side of the proximal section 103, such that it is on the same side of the system 101 as the second pulley attachment clip 703*b*, that corresponds with the second pulley attachment clip 703*b*. It is contemplated that each pulley attachment clip 703*a*, 703*b* may correspond with several pulleys 807 that located on the same side of the system 101 as each pulley attachment clip 703*a*, 703*b*.

The straps 706*a*, 706*b*, 709*a*, 709*b* may pass through the pulley 807 that is located on the same side of the system 101 as the pulley attachments 703*a*, 703*b* that the straps 706*a*, 706*b*, 709*a*, 709*b* are attached to. Each strap 706*a*, 706*b*, 709*a*, 709*b* may pass through multiple pulleys 807. The straps 706*a*, 706*b* may have a handle 812 on the second end of the straps 706*a*, 706*b* that is sized to allow a hand to grip or pass through the handle 812. Alternatively, the second ends of the straps 706*a*, 706*b* may include clips that may connect to other aspects of the system 101, or to other attachments that may be relevant during usage of the system 101. Strap 709*b* is shown to connect a handlebar band 813, which may be an elastic member that connects to a handlebar 202*b* on a first end of the handlebar band 813, and has a connection member on a second end of the handlebar band 813.

Other aspects of the system 101 may contribute to or augment the workout. For instance, a bungee 819 may attach to the first structural member 108. The bungee 819 may have a handle 821. The bungee 819 may be provide a challenging hand- or foothold for a user during a workout. Additional bungees 819 may be added to the system 101, and bungees 819 may be able to be removed from the system 101 or moved to different attachment points.

DIGITAL ASPECTS

The following section of the disclosure is directed toward computing-enabled aspects of a digitally enhanced exercise system 101, which may augment the ability of the system 101 to provide a directed workout for a user. The exercise system 101 may include sensors, an interface, and a system controller that assist in providing feedback for an assistive workout.

Figure 9:
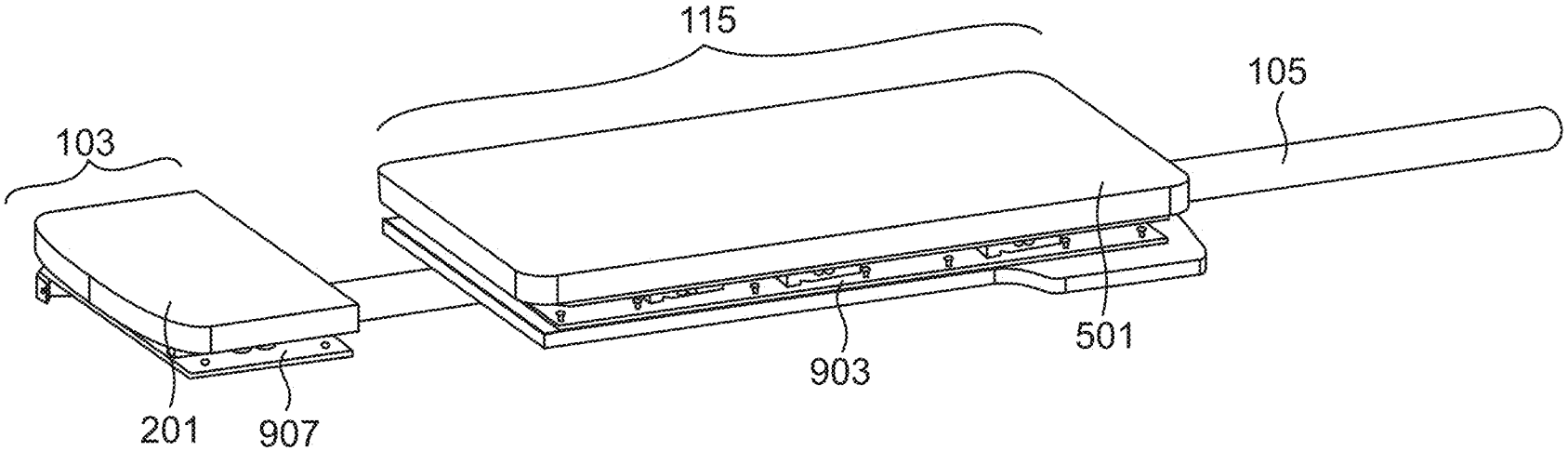
FIG. 9 illustrates aspects of an exemplary sensor array configuration for a digitally enhanced exercise system.
Figure 10:
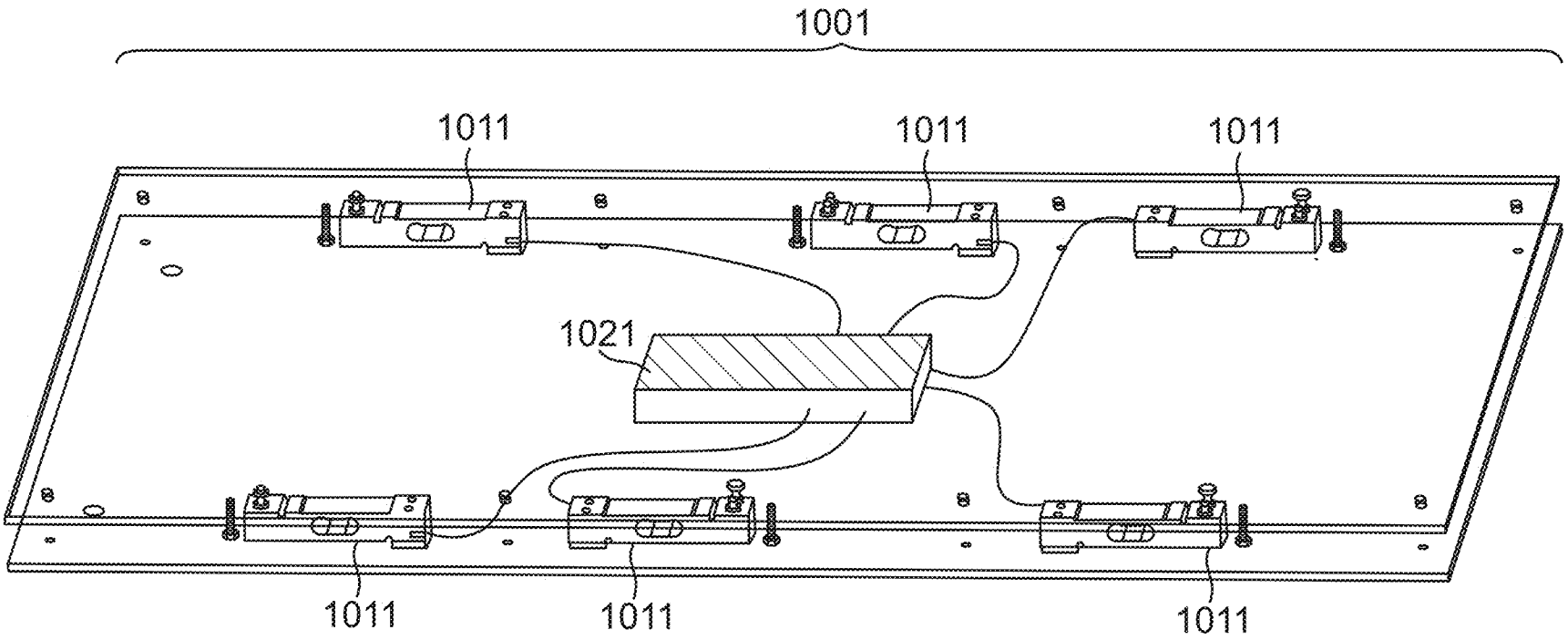
FIG. 10 illustrates an exemplary carriage sensor array configuration for a digitally enhanced exercise system.

Turning to FIG. 9, the carriage may include a sensor array capable of detecting changes in weight on the carriage. For instance, the carriage sensor array 903 may be disposed beneath the platform 501 and between the frame plates 509, such that the carriage sensor array 903 may be disposed between the platform 501 and the carriage frame 505. The sensor array 903 may include a load cell, such as a straight load cell, miniature load cell, beam load cell, canister style load cell, tension load cell, and compression load cell. The carriage sensor array 903 may include several load cells, wherein the load cells may be disposed at various points within the carriage 115 so as to obtain a cumulative measurement of weight delta on the carriage, and alternatively, or additionally, the load cells may be disposed so as to determine weight delta across or at various points across the carriage 115, such as, for instance, a mesh of load cells that may be disposed across the carriage 115 to determine the location and amount of force that is applied to specific locations on the top portion 105 of the carriage 115. The carriage sensor array 903 may include load cells that are of the same type of load cells or of different types of load cells. In FIG. 10, the carriage sensor array 903 is shown to include six load cells 1011 that sit under the platform 501, such that the load cells 1011 may be zeroed or tared so as to measure the relative difference in weight applied to the carriage 115 relative to when the carriage 115 is carrying no load. Greater or fewer than six load cells 1011 are considered, as well as other locations and configurations within the carriage 115. The load cells 1011 may be connected to a carriage controller 1021.

Figure 11:
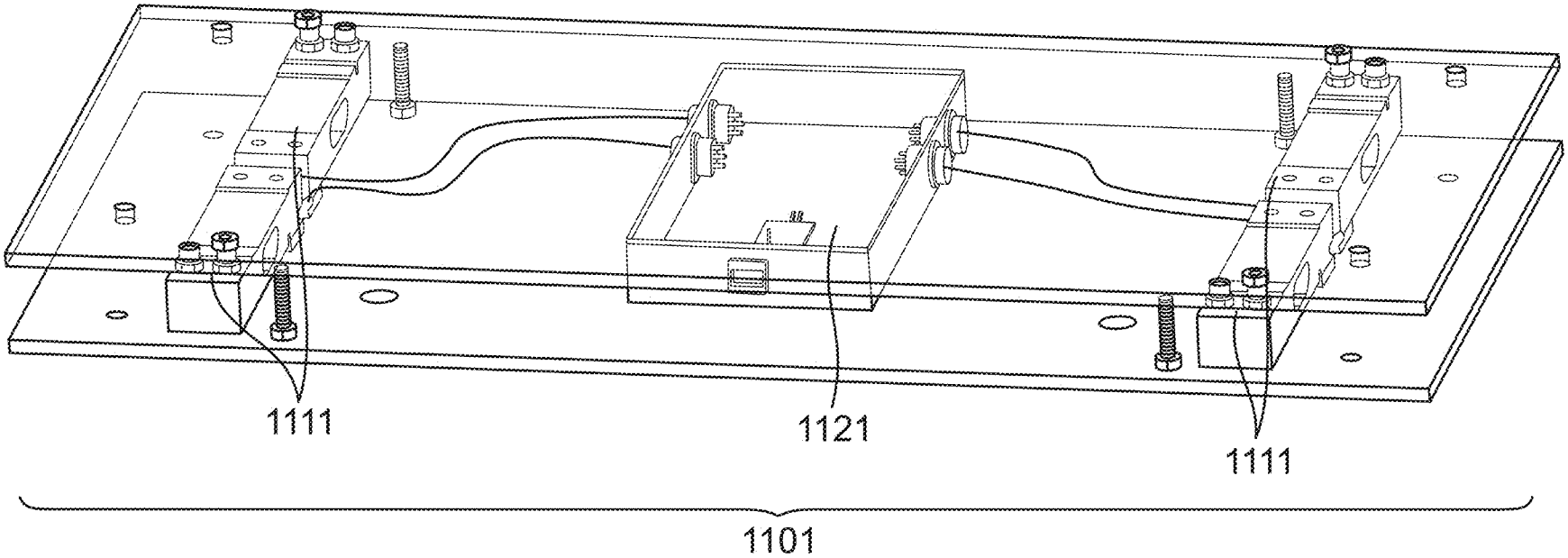
FIG. 11 illustrates an exemplary platform sensor array configuration for a digitally enhanced exercise system.

FIG. 11 demonstrate an exemplary embodiment of the platform sensor array 1101, which may be arranged in a similar manner to the carriage sensor array 1001. For example, the platform sensor array 1101 may include load cells 1111 configured to measure a change in pressure applied to the platform 201. In the illustration, the platform sensor array 1101 is shown to include four load cells 1111, although fewer or more load cells 1111 within the array are contemplated. The load cells 1111 may be connected to a platform controller 1121.

Figure 12:
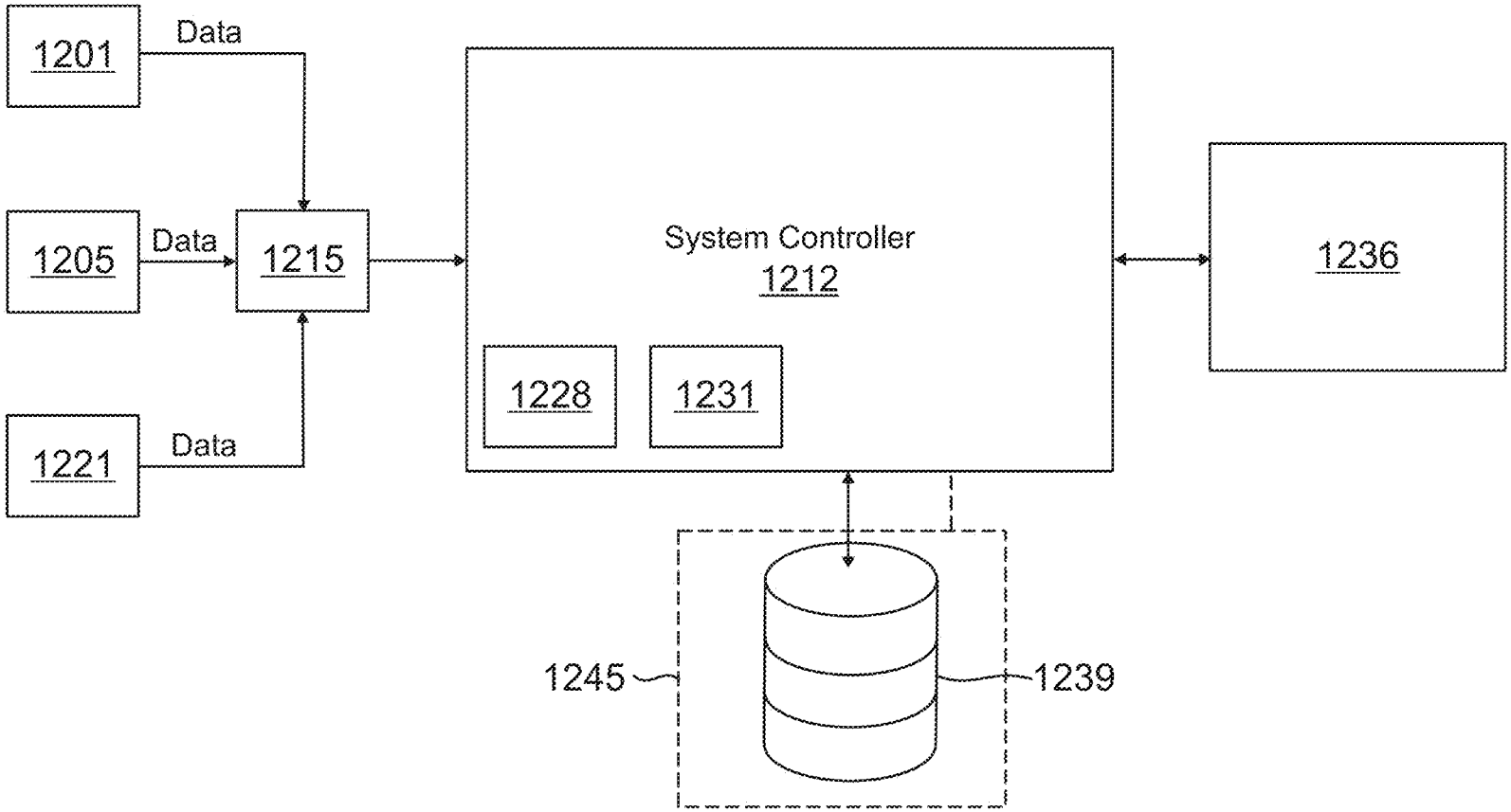
FIG. 12 illustrates an exemplary block diagram for a system controller.

An exemplary configuration for a system controller is shown in FIG. 12. The carriage sensor array 1201 and the platform sensor array 1205 may output data to the system controller 1212. The data may be processed through a signal conditioner 1215, such as a load cell amplifier that performs signal conditioning on the raw signal from the load cells 1011, 1111. The signal conditioner 1215 may ensure that a final output voltage produced by the load cells 1011, 1111 is accurate and free from noise and fluctuations. The signal conditioner 1215 may use other signal conditioning and digital signal processing techniques, such as filtering, equalizing, and linearization.

The system controller 1212 may similarly receive data from other system sensors 1221 that may be located within the system 101. For instance, the system sensors 1221 may be any or all of a wide range of sensors, such as load cells, infrared position detectors, optical encodes, potentiometers, magnets, pressure foil mechanisms, heart rate monitors, microphones, cameras, heart rate sensors, temperature sensors, and other sensors, that are integrated into the system 101 or otherwise capable of being used to measure various attributes related to the system 101 and the user. For example, a sensor may be used to determine the location of the carriage relative to the spine 105. For instance, a magnetic field sensor array, such as an RFID reader, may be positioned along the inside of the spine 105. A corresponding transmitter may be located on the carriage 115. The sensors disposed along the inside of the spine 105 may determine the position of the carriage 115 along the spine 105, such as by interpolation of the transmitter signal by the sensors. Similarly, the sensors may be arranged in order to determine a movement speed of the carriage 115 as the carriage 115 slides along the spine 105. Other means of determining the carriage 115 position and speed may be considered. The exercise system 101 may have additional weight sensors that may be located at any or all of various points throughout the system 101, such as in addition to or instead of those previously described, and may be used to determine the user's weight distribution across the system 101. There may be sensors capable of measuring other attributes of forces applied to the machine as well. For instance, returning to FIG. 6, a force transducer sensor may be connected between a tension member 628*a-h* and the carriage 115 in order to measure attributes of the force that is applied to the tension member when the user moves the carriage from a static position. For instance, the force transducer sensor may determine the amount of tension force produced by the tension member on the carriage 115. As the user slides the carriage 115 further in the direction opposite from the side of the carriage 115 where the tension member 628*a-h* is attached, the force transducer sensor may register that the tension force is increasing. The system controller 1212 may use the data collected to derive other relevant data. For instance, the system controller 1212 may determine use the tension data to determine tension on a time basis, such that time under tension and rate of tension change may be calculated.

Returning to FIG. 12, the platform controller 1228 may process data related to the platform data sensors 1205. The carriage controller 1231 may process data related to the carriage sensor array 1201. From the data, the system controller 1212 may be able to determine various attributes of the user and information about the user's utilization of the system 101. For example, the system controller 1212 may collate the sensor data relating to weight across the system 101 to determine the total weight of the user and the weight distribution of the user while the user is engaged with the system 101. The system controller 1212 may use the data when calculating apportionment of the user's weight that is concentrated on the platform array 1205 and on the carriage sensor array 1201. If a user has a foot on the platform 201 and a foot on the carriage 115 with the weight of user equally distribute across both the platform 201 and the carriage 115, the system controller 1212 may collate the data recorded by the carriage sensor array 1201 and the platform sensor array 1215, determining from the data set that the user has a foot on the platform 201 and a foot on the carriage 115 with the weight of the user equally distributed across the platform 201 and the carriage 115. The system controller may be able to determine from the data, when the carriage 115 has a mesh of sensors, the precise location of the user's foot on the carriage 115.

The system controller 1212 may transmit data to the interface 1236 so that it is viewable to the user. The system controller 1212 may display relevant information on the interface 1236, such as the information relating to the weight distribution of the user across the system 101. The system controller 1212 may receive and display the information on the interface 1236 on a substantially "live" or continuous basis such that the user is able to see information about their workout on the system 1236 in real-time.

The system controller 1212 may connect with a database 1239 that may store information related to operation of the system 101. The database 1239 may be able to store data received or calculated by the system controller 1212. The information may pertain to individual users of the system 101, allowing for contiguous use by different individuals, so that when any individual user is operating the system, the system controller 1212 may recall and utilize specific information that is relevant to that user. The user may input user data or the user data may be determined directly or indirectly, such as collated by the system controller 1212 from the sensors 1201, 1205, 1221. User data may include, for example, the weight and height of the user, fitness goals, injury history, and other relevant personal fitness information. The user data may be added to a user profile. The user profile may also include a history of usage data that correlates to data collected or inputted by the user during past usage of the system 101. When the user uses the system 101, the user profile may be selected or determined for the specific user, such that each of several users may have a user profile that corresponds to that user, which may include that user's user data and usage history.

The database 1239 may contain workout information regarding operation of the system. For example, the database may have information regarding specific workouts or rehabilitation techniques and how the system 101 is operated to implement the workouts and techniques. The user may select a workout from the database 1239 using the interface 1236. The interface 1236 may display instructions for completing the workout. The system controller 1212 may monitor the user's activity via the sensors 1201, 1205, 1221 while the user is engaged in the workout. The system controller 1212 may compare the workout sensor data with an ideal data set that is linked to the workout. The ideal data set may be contained within the database 1239. The ideal data set may be selected and/or adjusted based on information from the user profile of the user. Height, weight, and/or fitness goals for the user may be important factors in determining an appropriate exercise for the user and tailoring the exercise to the user's physical attributes. For instance, the ideal dataset may contain an ideal body positioning for a user that incorporates elements such as weight distribution. The ideal body position for a user that is six feet tall may vary from the ideal body position for a user that is five feet tall, and so the system controller 1212 may select an ideal dataset that corresponds with the height of the user profile that is selected. The system controller 1212 may display feedback on the interface 1236 that assists the user in bringing their workout closer to the ideal workout that is reflected by the ideal workout dataset. For instance, the ideal workout may have a dataset that shows that an ideal workout requires the user to have a substantially evenly distributed weight balance between one of the platforms and the carriage during a specific exercise. The system controller 1212 may determine that the user has a greater portion of the user's weight on the carriage 115 than on the platform 201. The system controller 1212 may display instructions on the interface 1236 indicating that the user should partially shift their weight from the carriage 115 to the platform 201, using a feedback loop to determine when the user has brought their weight distribution into alignment with the ideal data set. Other means of assisting the user with bringing their workout closer to an ideal workout may be considered. For instance, the system controller 1212 may utilize optical sensors to determine body position of the user. The system controller 1212 may compare the body position of the user with an ideal dataset of body position for the specified workout, and display feedback on the interface 1239 instructing the user to bring their body position closer to the ideal so that the weight distribution of the user is in compliance with the weight distribution of the ideal data set.

The interface 1236 may be used to display workouts, such as through providing graphical and audio instructions regarding a selected exercise program prior to or in sync with the user performing the selected exercise program. The instruction may take any of several forms. For instance, the interface 1239 may display a model of the exercise that is to be performed, allowing the user to mirror the model. The interface 1236 may display weight distribution goals, helping the user to determine how to position their body weight across the system 101. Other means and forms of instruction assisting the user in performing a selected exercise may be considered without departing from the inventive concept. When multiple interfaces 1236 are incorporated into the system, each interface 1236 may display different information. For example, a first interface may display workout instructions while a second interface may display sensor feedback from the system 101.

The system controller 1212 may use data derived from the system sensors 1221 within the tension system during the workout. Attributes such as the force profile produced by the user during the workout, which may include, for example, the amount of force utilized, the length of time under tension, and the speed under which the force is produced, may be collated by the system controller 1212 and stored in the database 1239 and/or displayed on the interface 1236. The force profile may be compared to the ideal dataset while instructing the user on completing an ideal workout. The force profile may be stored in the database 1239 for the user for use or comparison during future workouts. The force profile may be used in part to determine whether the user is using an appropriate configuration of the tension system. If the system controller 1212 determines that the workout is too strenuous for the user, the system controller 1212 may instruct the user to reconfigure the tension system into a configuration that is more appropriate, or the system controller 1212 may adjust the tension system, such as when the tension system is digitally operated. In another example, the ideal workout data for a lunge conducted using the system may recommend a pace of eight seconds for the user with a foot on the carriage 115 to slide the carriage 115 from a starting position to an ending position. If the user moves too fast or too slowly compared to the ideal pace, as derived by system controller 1212 from the tension data and/or position data, the system controller 1212 may display feedback indicating that the user should slow down or speed up, respectively.

Another aspect is directed toward a network connected exercise system. Components of the system may communicate with local and/or remote computing systems 1245, including processing and storage devices, via any suitable communications protocol and network, using any suitable connection including wired or wireless connections. In various exemplary embodiments, local communication may be managed using a variety of techniques. For example, local communication may be managed using wired transport with a serial protocol to communicate between sensors and the system controller. Local communication may also be managed using a wireless communication protocol such as the ANT or ANT+ protocol.

The remote computing systems 1245 may manage various aspects of the system 101. For example, the remote computing systems 1245 may distribute the workout to the user while the user is operating the system. The workout may be a live workout that is being performed substantially concurrently by an instructor, such as a professional trainer. The remote computing systems 1245 may stream the workout to the interface 1236 of the user. In another example, the workout may be archived, such as if it was performed by an instructor at an earlier time and may be streamed to the user "on demand" when the user requests the workout using the interface.

The data flow between the system controller 1212 and the remote computing system 1245 may be multi-directional, allowing the system controller 1212 and remote computer system 1245 to exchange information in tandem. The system controller 1212 may stream information regarding the workout of the user to the remote computing system 1245. For instance, the user's information, such as weight distribution data, audio feeds, or video feeds, may be used by an instructor that is located remotely from the user. The instructor may use the information to provide tailored instructions in real time to the user.

The remote computer system 1245 may coordinate multiple users and/or instructors at once. For instance, when an instructor is conducting a live class, the remote computer system 1245 may stream the class to each user that has indicated a desire to receive the class, such as by "joining" the class through the interface 1236. The data from each user may be streamed from the system controller 1212 of the user to the remote computer system 1245. The remote computer system 1245 may use the data in any number of ways, such as collating global information about the users that are engaged in a live class. This information may be streamed back to the user in order that each user may see displayed on their interface 1236 information relating to their workout session as compared to the workout sessions of all users engaged in the class. Such feedback may be streamed multi-directionally on a substantially continuous basis throughout the duration of the class. All data, such as individual workout data, user data, and global workout data, may be stored by the remote computer system 1245 and used for various purposes, including feedback, diagnostics, individual performance metrics, and ongoing global performance metrics. For example, the database 1239 may be stored in the remote computer system 1245. Similarly, or alternatively, information generated or stored globally may be stored locally, such that information may be stored and/or distributed in a decentralized manner.

The features of the present embodiments may be implemented in a computer system that includes a back-end component, such as a data server, and/or that includes a middleware component, such as an application server or an Internet server, and/or that includes a front-end component, such as a client computer having a graphical user interface (GUI) and/or an Internet browser, or any combination of these. The components of the system may be connected by any form or medium of digital data communication, such as a communication network. Examples of communication networks may include, for example, a LAN (local area network), a WAN (wide area network), and/or the computers and networks forming the Internet.

The computer system may include clients and servers. A client and server may be remote from each other and interact through a network, such as those described herein. The relationship of client and server may arise by virtue of computer programs running on the respective computers and having a client-server relationship to each other.

The system controller 1212 may be integrated into the system 101, such as connected to the frame, located externally to the system, or located remotely. The system controller 1212, carriage controller 1231, and platform controller 1228 may be embodied, at least in part, as one or more embedded or general-purpose processors, computers, processing devices, or computing devices having memory. For instance, it is contemplated that the system controller 1212, carriage controller 1231, and platform controller 1228 may be represented as functionalities within a single controller, or across multiple controllers. The system controller 1212 may also be embodied, in part, as various functional and/or logic (e.g., computer-readable instruction, code, device, circuit, processing circuit, etc.) elements executed or operated to perform aspects of the embodiments described herein.

The system controller 1212 may include a processor, a memory, a storage device, and input/output (I/O) devices. Some or all of the components may be interconnected via a system bus. The processor may be single- or multi-threaded and may have one or more cores. The processor may execute instructions, such as those stored in the memory and/or in the storage device. Information may be received and output using one or more of the I/O devices.

The memory may store information, and may be a computer-readable medium, such as volatile or non-volatile memory. The storage device(s) may provide storage for the computer system and may be a computer-readable medium. In various embodiments, the storage device(s) may be one or more of a flash memory device, a hard disk device, an optical disk device, a tape device, or any other type of storage device.

The I/O devices may provide input/output operations for the computer system.

The I/O devices may include a keyboard, a pointing device, and/or a microphone. The I/O devices may further include a display unit for displaying graphical user interfaces, a speaker, and/or a printer. External data may be stored in one or more accessible external databases.

The features of the present embodiments described herein may be implemented in digital electronic circuitry, and/or in computer hardware, firmware, software, and/or in combinations thereof. Features of the present embodiments may be implemented in a computer program product tangibly embodied in an information carrier, such as a machine-readable storage device, and/or in a propagated signal, for execution by a programmable processor. Embodiments of the present method steps may be performed by a programmable processor executing a program of instructions to perform functions of the described implementations by operating on input data and generating output.

The features of the present embodiments described herein may be implemented in one or more computer programs that are executable on a programmable system including at least one programmable processor coupled to receive data and/or instructions from, and to transmit data and/or instructions to, a data storage system, at least one input device, and at least one output device. A computer program may include a set of instructions that may be used, directly or indirectly, in a computer to perform a certain activity or bring about a certain result. A computer program may be written in any form of programming language, including compiled or interpreted languages, and it may be deployed in any form, including as a stand-alone program or as a module, component, subroutine, or other unit suitable for use in a computing environment.

Suitable processors for the execution of a program of instructions may include, for example, both general and special purpose processors, and/or the sole processor or one of multiple processors of any kind of computer. Generally, a processor may receive instructions and/or data from a read only memory (ROM), or a random access memory (RAM), or both. Such a computer may include a processor for executing instructions and one or more memories for storing instructions and/or data.

Generally, a computer may also include, or be operatively coupled to communicate with, one or more mass storage devices for storing data files. Such devices include magnetic disks, such as internal hard disks and/or removable disks, magneto-optical disks, and/or optical disks. Storage devices suitable for tangibly embodying computer program instructions and/or data may include all forms of non-volatile memory, including for example semiconductor memory devices, such as EPROM, EEPROM, and flash memory devices, magnetic disks such as internal hard disks and removable disks, magneto-optical disks, and CD-ROM and DVD-ROM disks. The processor and the memory may be supplemented by, or incorporated in, one or more ASIC s (application-specific integrated circuits).

Electronic aspects of the system may be connected by a wired or wireless system. Cables that connect components located in different parts of the system 101, such as between the proximal section 103, distal section 104, and carriage 115 may be stored within the spine 105 in order to contain and manage the cables and wires. For example, the electronics within the proximal section 103 may output a cable that carries data generated by the platform sensor array 1101. The platform sensor array 1101 may connect to the system controller 1212. For instance, when the system controller 1212 is located on the distal section 104, the cabling may pass through the spine 105 to reach the system controller 1212. The cables and wires that emerge from the carriage 115 may pass through the spine 105 though the cable management system as well. The cable management system may include a spool and a cable reservoir. When the carriage 115 slides in a first direction, the cables may spool into the cable reservoir. When the carriage 115 slides in a second direction, the cables may spool out of the reservoir. In this way, the cables are allowed to remain concealed within the spine 105 throughout operation of the system and remain orderly. Alternatively, wireless protocols such as, but not limited to, NFC, Bluetooth, and WAN may be used. The spine 105 may also serve as a throughway for power cables and/or a power management system.

Aspects of the present disclosure are directed toward elements of an interactive exercise program, wherein a user is able to interact with the system 101. The interface 121 may be connected to the system 101 in order to be accessible to the user. FIGS. 13-19 demonstrate information relating to operation of the system that may be displayed with a Graphical User Interface (GUI) on the interface 121, or another electronic device accessible to the user. Users may be able to navigate through the screens to obtain desired information or view desired screens.

Figure 13:
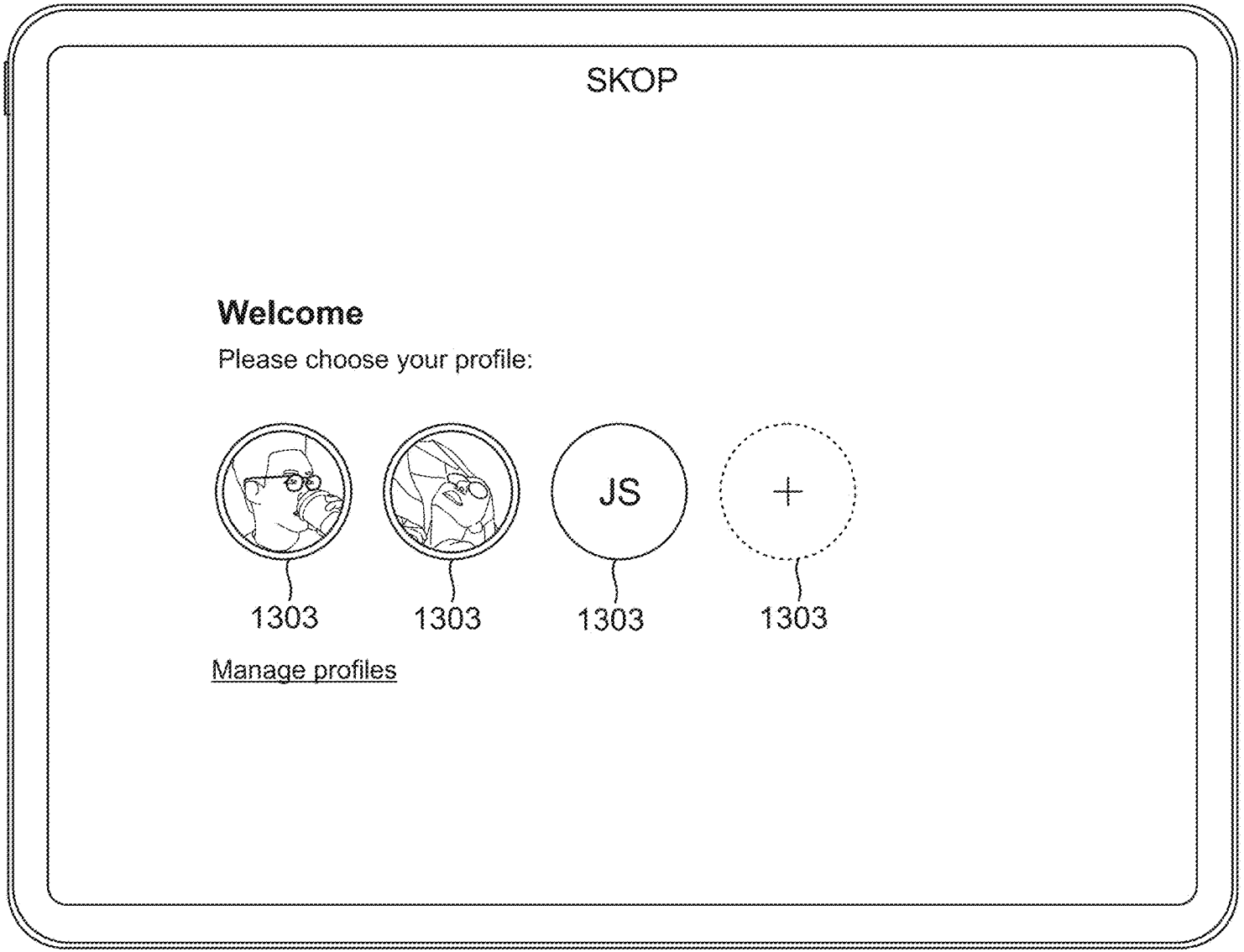
FIG. 13 illustrates an exemplary graphical user interface (GUI) for a welcome screen for a digitally enhanced exercise system.

FIG. 13 shows a welcome screen on which a user profile 1303 can be selected. The user profile 1303 may be associated with user data, such as outlined previously. The user may elect to create a new user profile 1303. Each user of the system 101 may have a user profile 1303 that corresponds with that user.

Figure 14:
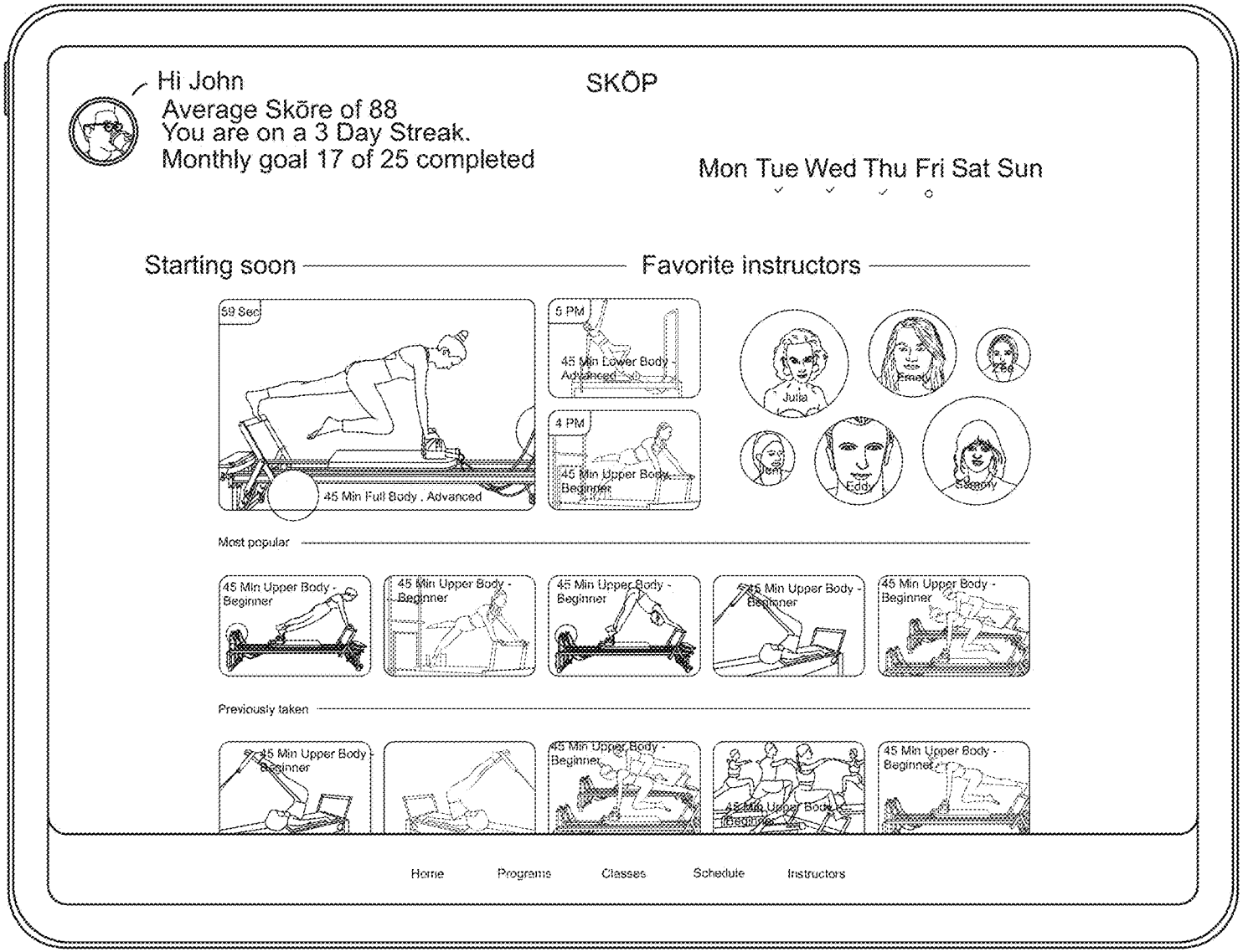
FIG. 14 illustrates an exemplary GUI for a home screen for a digitally enhanced exercise system.

FIG. 14 shows a home screen that illustrates various elements of the system 101. For instance, metrics involving usage of the user may be seen at the top of the screen, such as weekly usage, goals, streaks, and workout ratings. The home screen may also show workout information, such as information about live programming, links to preferred instructors, information about prescheduled or prerecorded workouts, and past workouts taken. The home screen may also include information regarding a "score" of the user. The score may be based, in part, on recent and/or global workout information for the user, such as completion of workouts, number of workouts, and effectiveness within workouts. The score may be normalized, such that the score is presented on a scale of, for example, one to one-hundred, wherein one is a low score and one-hundred is a high score, and determined using an algorithm that accounts for the relative scores of other users. The score may be presented in other manners, such as using a numerical range greater or smaller than "one to hundred," using colors, symbols, or other methods of demonstrating a user's relative change in performance.

Figure 15:
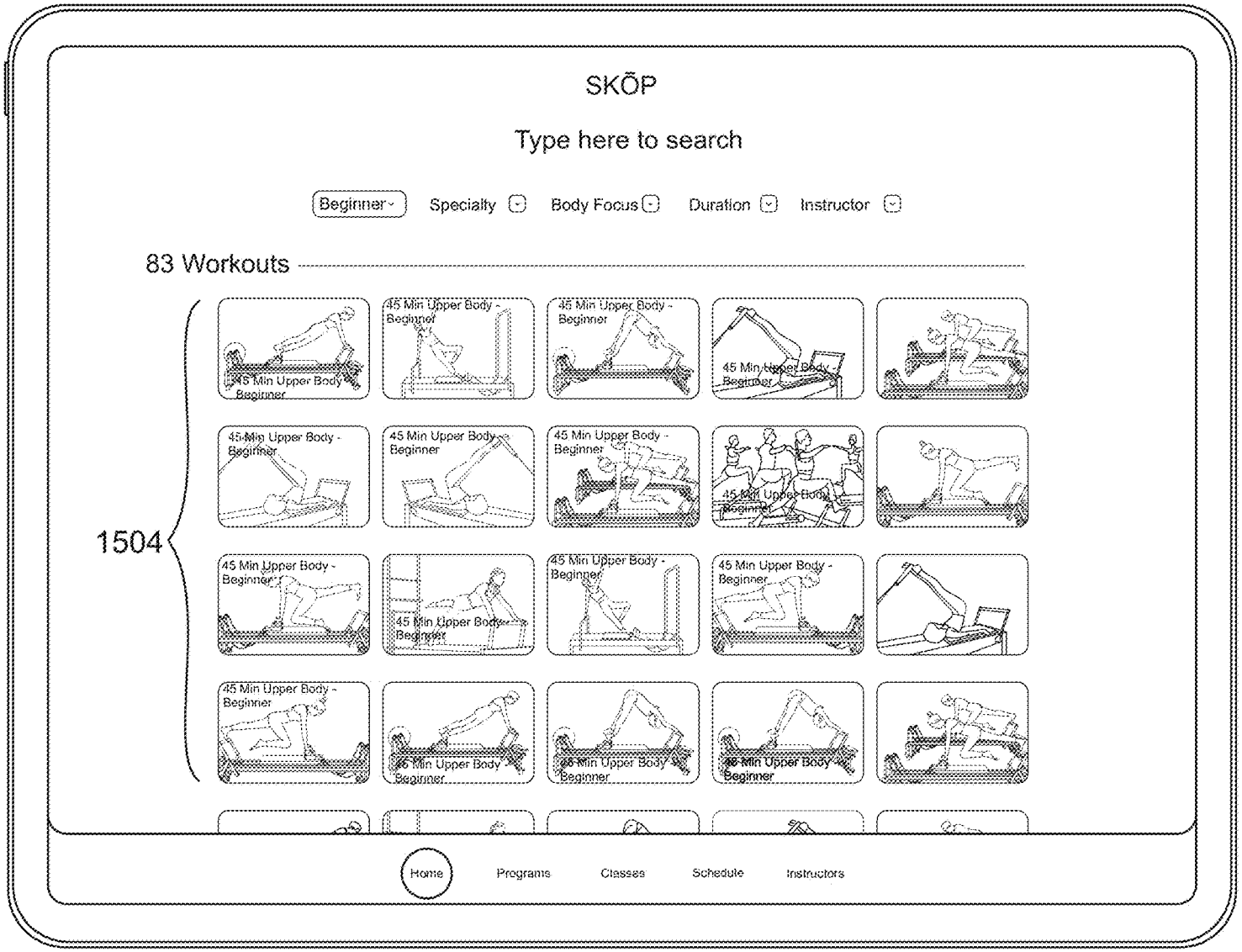
FIG. 15 illustrates an exemplary GUI for a workout selection screen for a digitally enhanced exercise system.

FIG. 15 demonstrates an exemplary workout selection screen. Workouts may be organized by specific attributes relating to the workout program, such as, but not limited to, difficulty level, specialty, body focus, duration, and instructor. The workout selection screen may display icons 1504 that represent workouts that match the selected attributes, allowing for a user to find and select a desired workout.

Figure 16:
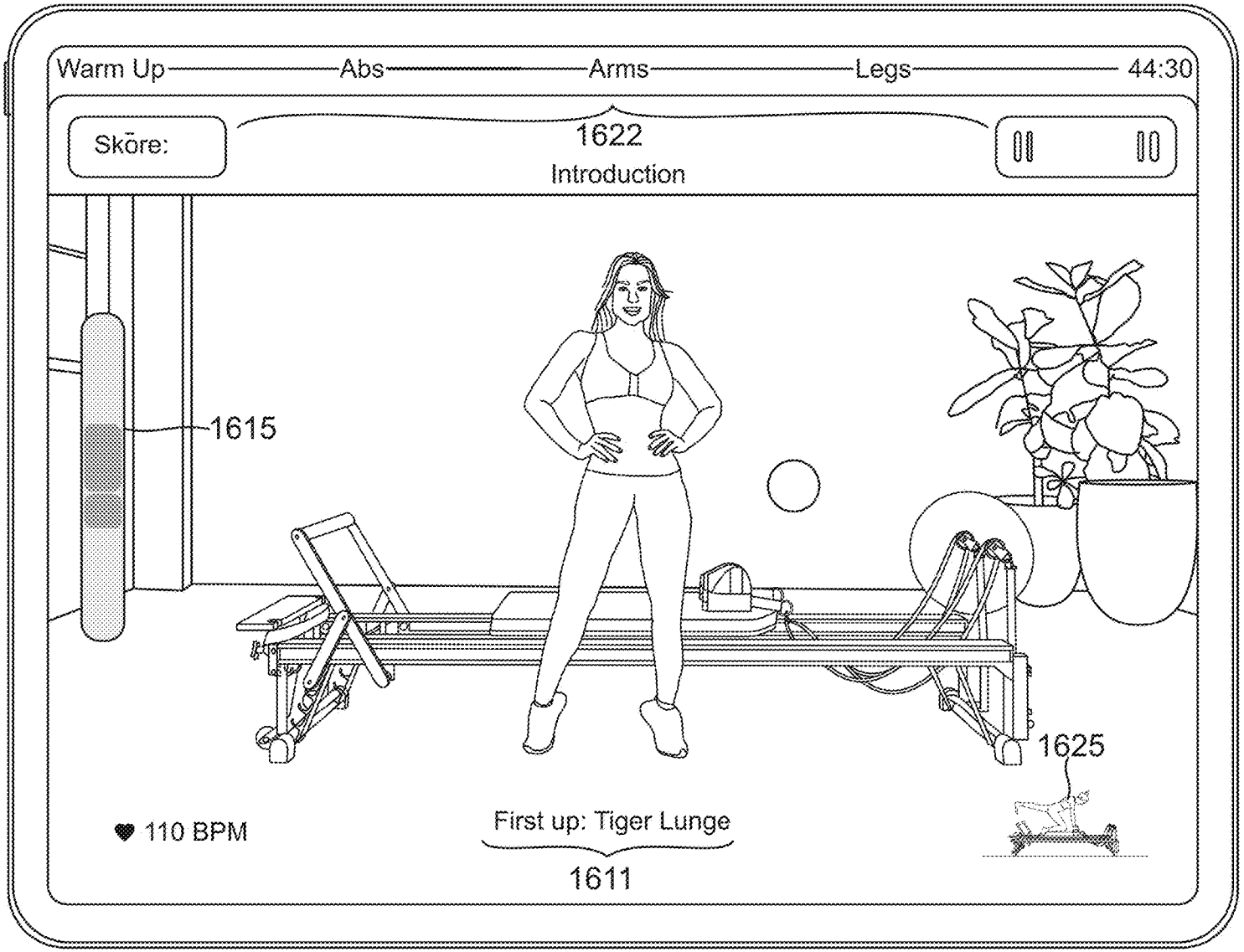
FIG. 16 illustrates an exemplary GUI for an instructional screen for a digitally enhanced exercise system.

A workout screen, such as shown in FIGS. 16-19, may include instructional workout elements. For example, FIG. 16 shows a streamed workout, which may have an instructor 1606 that is giving instructions to the user on how to use the system 101. The workout may be prerecorded by the instructor, such as in a remote exercise studio. Alternatively, the instructor may be conducting the class in real time, and so the workout conducted by the instructor may be live streamed to the user. The instructor 1606 may be engaged in the instructed exercise. An instructional message bar 1611 may have directions for the user, such as to change a configuration of the system 101, including the location of the handle bars or the amount of or force profile of tension members that are used. Various feedback may be displayed on the screen as well. For example, a balance bar 1615 may have feedback on the user's weight distribution across the system, allowing the user to correct their body positioning, form, speed, or other user exercise attributes in order to achieve a better workout. Other biofeedback may be displayed as well, such as the user's heart rate. A status bar 1622 may demonstrate temporal information about the workout, such as the length of the workout, the current time elapsed or remaining of the workout, the body part that the workout is currently focused on, and body parts that the workout will focus on in relation to time lapse information of the workout. An avatar 1625 may demonstrate the exercise that is about to performed, as noted in the instructional message bar 1611.

Figure 17:
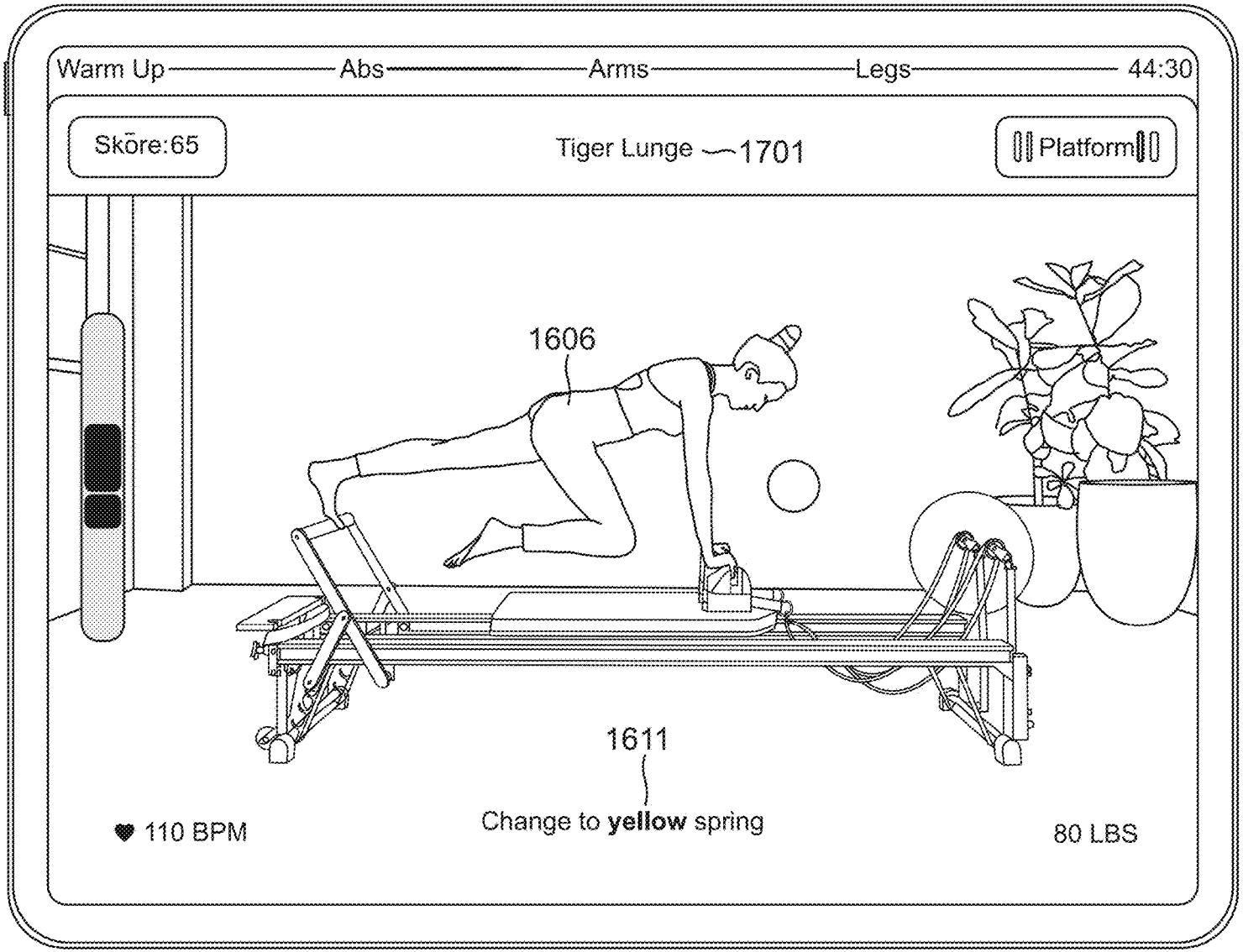
FIG. 17 further illustrates an exemplary GUI for an instructional screen for a digitally enhanced exercise system.
Figure 18:
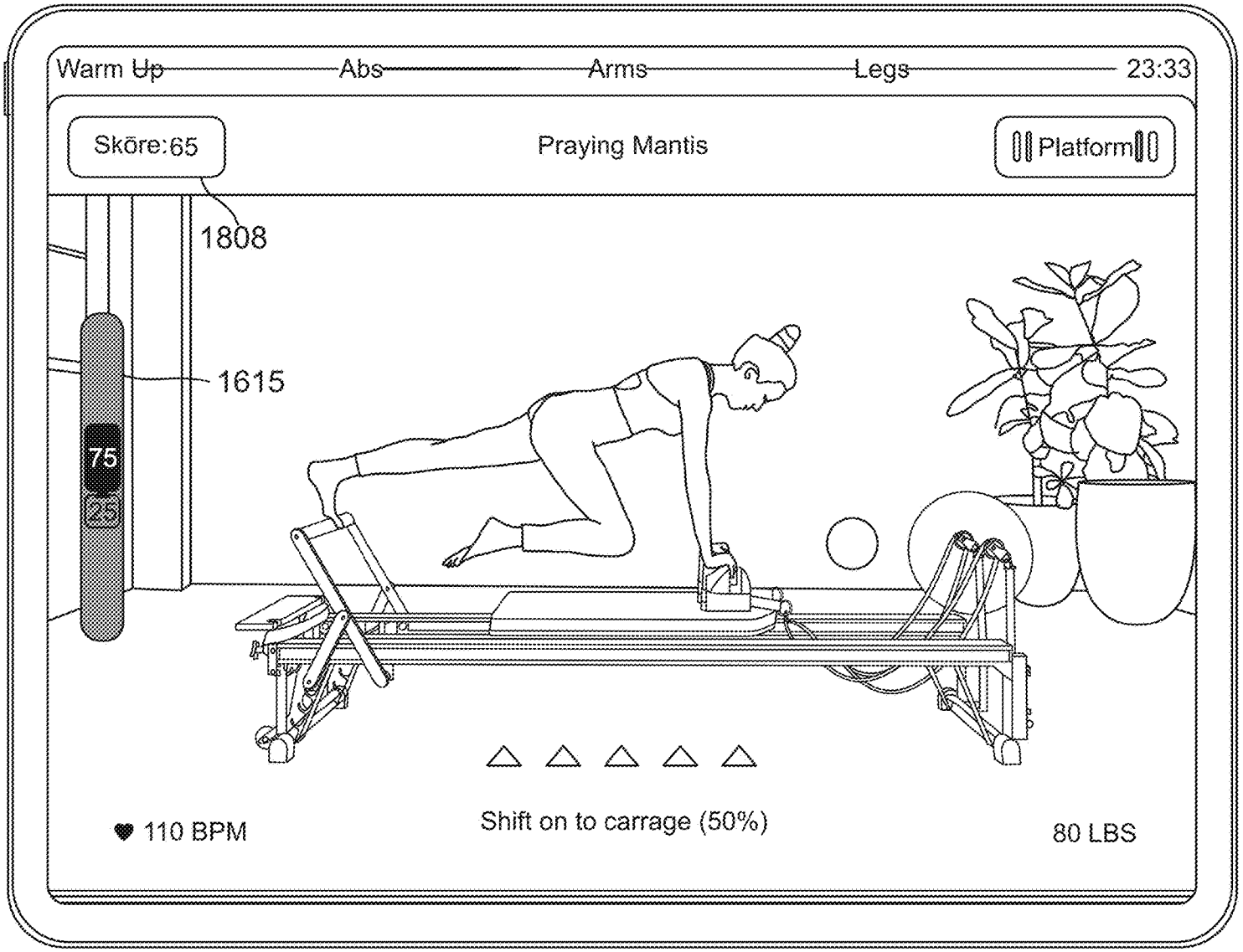
FIG. 18 illustrates another aspect exemplary GUI for an instructional screen for a digitally enhanced exercise system.
Figure 19:
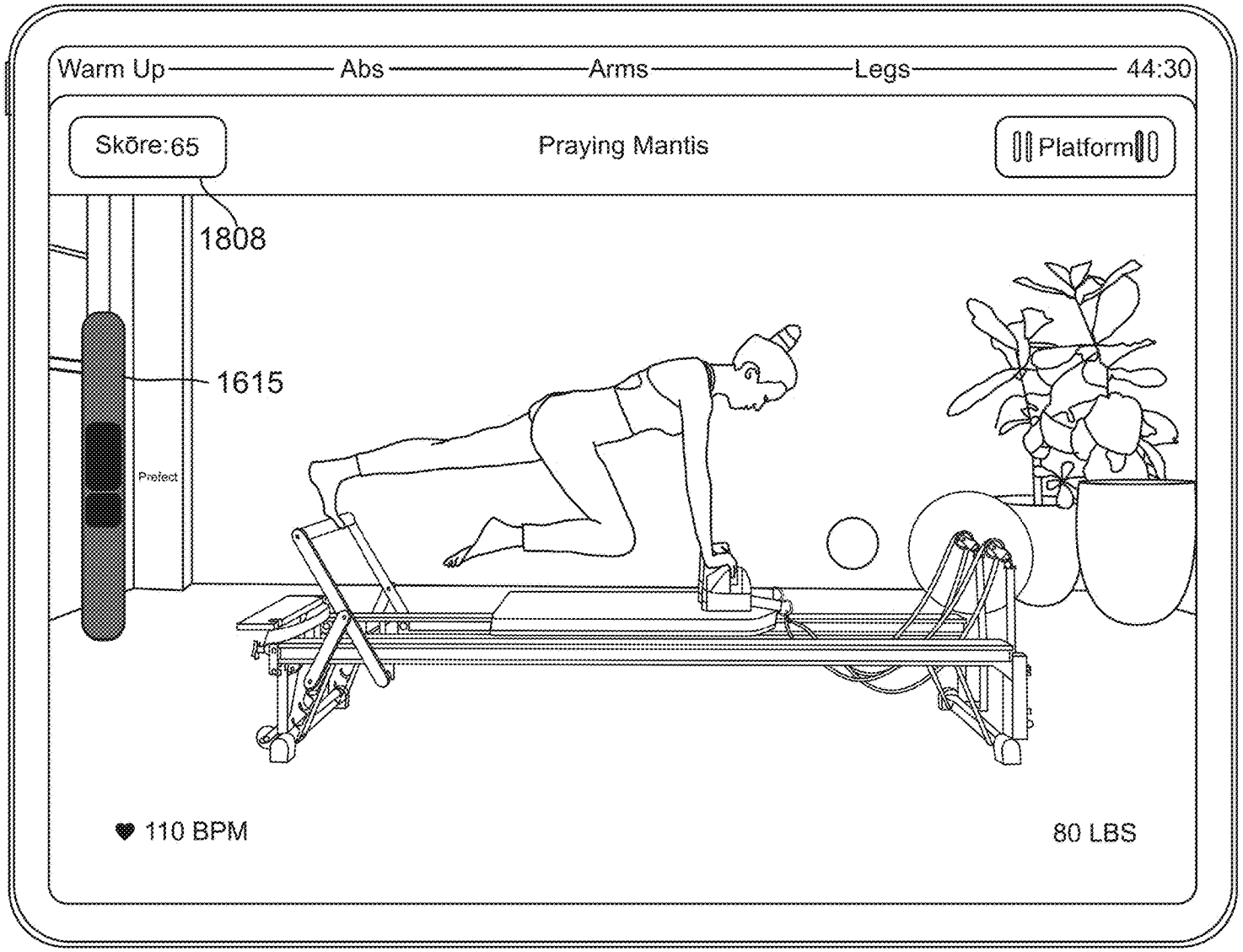
FIG. 19 illustrates yet another aspect of an exemplary GUI for an instructional screen for a digitally enhanced exercise system.

FIGS. 17-19 demonstrate the user weight distribution feedback on the screen. In FIG. 17, the instructor 1606 is demonstrating correct form for the exercise noted in the title bar 1701. The instructional message bar 1611 is telling the user the correct tension member to use. The instructional message bar 1611 may include other instructional information, such as hand placement, handle bar 202*a*, 202*b* configuration, and weight balance information. In FIG. 18, the balance bar 1615 displays that the user's weight distribution is not balanced. The user in this example is placing 25% of their weight on the platform 201 and 75% of their weight on the carriage 115, whereas in an ideal exercise the weight distribution of the user would be substantially split. Information relating to the ideal exercise may be displayed on the GUI in many forms. For instance, a "ghost" representation of the ideal weight distribution may be shown in the balance bar 1615 in comparison to the user's actual weight distribution, so that the user can see where their weight distribution differs from the ideal weight distribution. The ghost representation may take other forms as well, such as comparing a user's hand placement to an ideal hand placement, or comparing a user's carriage movement speed to an ideal carriage movement speed, wherein the ghost representation allows a user to visually compare an avatar of their current workout to an avatar of the ideal workout by superimposing the avatar of the ideal workout over the avatar of the current workout on the GUI in real-time. The balance bar 1615 may use colors, sounds, or other indicators when giving feedback so that the user may be made aware of their current performance and needed corrective measures. The compliance of the user toward an "ideal" exercise, accounting for the discussed user exercise attributes, may be reflected in a user score 1808, which may aggregate user data to measure the performance of the user. In FIG. 19, the balance bar 1615 shows that the user has corrected their form, such that the weight distribution of the user is substantially in the "ideal" range for the exercise.

While certain aspects have been described and shown in the accompanying drawings, it is to be understood that such are merely illustrative of and not restrictive on the broad invention, and that the invention is not limited to the specific constructions and arrangements shown and described. The description is thus to be regarded as illustrative instead of limiting.

What is claimed is:

1. A digitally enhanced exercise system, comprising:

a proximal section comprising a first structural member and a platform;

a distal section comprising a second structural member and an interface, wherein the interface is attached to the second structural member by a mount;

a spine that is spans between the first structural member and the second structural member;

a carriage configured to move on a single axis along the spine;

a tension system, wherein the tension system is capable of resisting the carriage from moving; and a controller.

2. The digitally enhanced exercise system of claim 1, further comprising a sensor array arranged so as to detect attributes of a user.

3. The digitally enhanced exercise system of claim 2, wherein the controller is configured to receive a weight data from the sensor array and determine a user workout attribute from the weight data.

4. The digitally enhanced exercise system of claim 2, wherein the sensor array comprises a carriage sensor array and a platform sensor array.

5. The digitally enhanced exercise system of claim 2, wherein the sensor array further comprises a sensor arranged within the tension system so as to measure a tension data.

6. The digitally enhanced exercise system of claim 1, further comprising sensors that are capable of being used to measure various attributes related to the digitally enhanced exercise system and a user of the digitally enhanced exercise system.

7. The digitally enhanced exercise system of claim 1, wherein the controller is configured to store a workout information.

8. The digitally enhanced exercise system of claim 7, wherein the controller is configured to stream the workout information to the interface.

9. The digitally enhanced exercise system of claim 1, further comprising components that communicate with remote computing systems.

10. The digitally enhanced exercise system of claim 1, wherein the distal section and the proximal section are coupled to the spine.

11. The digitally enhanced exercise system of claim 1, wherein the carriage is coupled to the tension system, and wherein the tension system includes a first tension member attached to the carriage and to the distal section, and wherein the tension system includes a second tension member attached to carriage and to the proximal section.

12. The digitally enhanced exercise system of claim 1, wherein the spine has a first longitudinal length, and wherein the spine is configured to telescope or retract to a second longitudinal length, different from the first longitudinal length.

13. The digitally enhanced exercise system of claim 1, wherein the proximal section comprises height adjustable handle bars configured to perform a full rotation.

14. A digitally enhanced exercise system, comprising:

a controller configured to:

receive sensor data comprising weight information detected by a first set of sensors and weight information detected by a second set of sensors, different from the first set of sensors, determine, from the sensor data, weight distribution data for a user, compare the weight distribution data for the user to an ideal weight distribution data, and instruct the user on how to bring the weight distribution data for the user into compliance with the ideal weight distribution data.

15. The digitally enhanced exercise system of claim 14, wherein instructing the user further comprises streaming an exercise instruction to an interface that is viewable by the user.

16. The digitally enhanced exercise system of claim 14, wherein the sensor data comprises a carriage weight data and a platform weight data.

17. The digitally enhanced exercise system of claim 14, further comprising streaming, to an interface, a workout instruction.

18. A method, comprising receiving, by a controller, sensor data comprising weight information detected by a first set of sensors and weight information detected by a second set of sensors, different from the first set of sensors, determining, from the sensor data, weight distribution data for a user, comparing the weight distribution data for the user to an ideal weight distribution data, and instructing the user on how to bring the weight distribution data for the user into compliance with the ideal weight distribution data.

19. The method of claim 18, wherein instructing the user further comprises streaming an exercise instruction to an interface that is viewable by the user.

20. The method of claim 18, wherein the sensor data comprises a carriage weight data and a platform weight data.

21. The method of claim 18, further comprising streaming, to an interface, a workout instruction.

22. The method of claim 18, further comprising determining, from the sensor data, a system attribute data.

23. The method of claim 22, wherein the system attribute data includes a carriage speed.

24. The method of claim 22, further comprising comparing the system attribute data to an ideal attribute data.

25. The method of claim 18, wherein instructing the user on how to bring the weight distribution data for the user into compliance with the ideal weight distribution data comprises displaying, on an interface, a ghost representation of the ideal weight distribution data that is superimposed over an avatar of the weight distribution data for the user.

* * * * *